US011610570B2

(12) United States Patent
Takasaki et al.

(10) Patent No.: US 11,610,570 B2
(45) **Date of Patent: *Mar. 21, 2023**

(54) ELECTRONIC PERCUSSION INSTRUMENT AND SOUND PRODUCTION CONTROL METHOD THEREOF

(71) Applicant: Roland Corporation, Shizuoka (JP)

(72) Inventors: Ryo Takasaki, Shizuoka (JP); Yoshiaki Mori, Shizuoka (JP); Kenji Morita, Shizuoka (JP); Norihiro Yoshikuni, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/842,807

(22) Filed: Jun. 17, 2022

(65) Prior Publication Data

US 2022/0319485 A1 Oct. 6, 2022

Related U.S. Application Data

(63) Continuation of application No. 16/330,372, filed as application No. PCT/JP2017/028803 on Aug. 8, 2017, now Pat. No. 11,404,037.

(30) Foreign Application Priority Data

Sep. 5, 2016 (JP) ..... JP2016-172801

(51) Int. Cl.
*G10H 3/14* (2006.01)
*G10H 1/34* (2006.01)
*G10H 3/10* (2006.01)

(52) U.S. Cl.
CPC ..... *G10H 3/146* (2013.01); *G10H 1/34* (2013.01); *G10H 3/10* (2013.01)

(58) Field of Classification Search
CPC ..... G10H 3/146; G10H 1/34; G10H 3/10
(Continued)

(56) References Cited

U.S. PATENT DOCUMENTS 4,852,443 A * 8/1989 Duncan ..... G10H 3/146 84/DIG. 12
5,177,311 A * 1/1993 Suzuki ..... G10H 1/34 84/DIG. 12

(Continued)

FOREIGN PATENT DOCUMENTS

CN 102314861 1/2012
CN 104424937 3/2015

(Continued)

OTHER PUBLICATIONS

"Office Action of China Counterpart Application", dated Oct. 31, 2022, with English translation thereof, p. 1-p. 11.

(Continued)

*Primary Examiner* — Christina M Schreiber
(74) *Attorney, Agent, or Firm* — JCIPRNET

(57) ABSTRACT

An electronic percussion instrument and sound production control method thereof are provided. In an electronic cymbal, the output of a musical sound is controlled in accordance with the results of detection from a strike sensor when the strike sensor detects a strike on a striking surface. While the musical sound is output, if a user touches the striking surface, an electrostatic capacitance sensor outputs an output value in accordance with the contact condition so that the musical sound is attenuated in accordance with the output value while being output. Therefore, the user can attenuate the musical sound being output in accordance with the contact conditions on the striking surface, thereby silencing (Continued)

the musical sound by way of the action similar to that of the acoustic cymbal choke that is the action of touching the striking surface.

14 Claims, 13 Drawing Sheets

(58) Field of Classification Search
USPC ..... 84/600
See application file for complete search history.

(56) References Cited

U.S. PATENT DOCUMENTS 5,262,585 A * 11/1993 Greene ..... G10H 1/0066 84/738
5,915,289 A * 6/1999 Hart ..... G10H 3/143 84/DIG. 12
7,323,632 B2 * 1/2008 Wachter ..... G10H 3/146 310/329
7,405,353 B2 * 7/2008 Kiyono ..... A63F 13/214 84/411 R
9,245,510 B2 * 1/2016 Truchsess ..... G10H 3/143
9,263,012 B2 * 2/2016 Truchsess ..... G10H 3/146
11,404,037 B2 * 8/2022 Takasaki ..... G10H 3/146
2006/0021495 A1 * 2/2006 Freitas ..... G10H 3/10 84/723
2008/0238448 A1 * 10/2008 Moore ..... G10H 3/10 324/686
2009/0151475 A1 * 6/2009 Masaki ..... G01L 1/146 73/862.68
2009/0229450 A1 * 9/2009 Hashimoto ..... G10H 3/146 84/723
2012/0118130 A1 * 5/2012 Field ..... G10D 13/02 84/723
2013/0076542 A1 * 3/2013 Tanaka ..... G10H 1/0558 200/5 A
2013/0340598 A1 * 12/2013 Marquez ..... G10H 3/146 84/730
2015/0143979 A1 * 5/2015 Field ..... G10D 13/11 84/730
2016/0019873 A1 * 1/2016 Mori ..... G10H 1/00 84/422.1
2016/0196811 A1 * 7/2016 Shen ..... G10H 3/146 84/422.1
2017/0047056 A1 * 2/2017 Lee ..... G10H 1/0008
2017/0116972 A1 * 4/2017 Yoshino ..... G10H 3/146
2017/0229104 A1 * 8/2017 Suitor ..... G10D 13/26
2017/0236505 A1 * 8/2017 Takasaki ..... G10H 1/0551 84/723
2019/0172435 A1 * 6/2019 Zhong ..... G10H 3/12
2019/0392804 A1 * 12/2019 Yoshino ..... G10H 1/0551
2021/0142771 A1 * 5/2021 Yoshino ..... G10H 3/146
2021/0201874 A1 * 7/2021 Takasaki ..... G10H 3/146
2022/0319485 A1 * 10/2022 Takasaki ..... G10H 1/0551

FOREIGN PATENT DOCUMENTS

CN 213583092 U * 6/2021
JP H0210596 1/1990
JP H0511755 1/1993
JP 05165469 A * 7/1993
JP H05165469 A * 7/1993
JP H0635450 2/1994
JP H09160558 A * 6/1997
JP 2003108140 4/2003
JP 2008052291 3/2008
JP 2009237296 A * 10/2009
JP 2010113028 5/2010
JP 2017146461 A * 8/2017 ..... G10D 13/024

OTHER PUBLICATIONS

Zhang Chongbin, "Research on the application of electronically synthesized timbre in computer music production," Nanjing Arts Institute, Master's Thesis, Apr. 2008.
Tang Yu et al., "The statistic result of synthesis on the aortic sound of dogs from beat to beat," Images of the Twenty-First Century. Proceedings of the Annual International Engineering in Medicine and Biology Society, Aug. 2002, pp. 0673-0674.

* cited by examiner

ELECTRONIC PERCUSSION INSTRUMENT AND SOUND PRODUCTION CONTROL METHOD THEREOF

CROSS-REFERENCE TO RELATED APPLICATION

The present application is a continuation application of U.S. application Ser. No. 16/330,372 filed on Mar. 5, 2019, now allowed. U.S. application Ser. No. 16/330,372 is a 371 application of the International PCT application Ser. No. PCT/JP2017/028803, filed on Aug. 8, 2017, which claims the priority benefits of Japan Patent Application No. 2016-172801, filed on Sep. 5, 2016. The entirety of each of the above-mentioned patent applications is hereby incorporated by reference herein and made a part of this specification.

TECHNICAL FIELD

The present invention relates to an electronic percussion instrument. Particularly, the present invention relates to an electronic percussion instrument that can realize an operation similar to choke playing in an acoustic percussion instrument.

DESCRIPTION OF RELATED ART

An electronic cymbal is one type of electronic percussion instrument. In an electronic cymbal in Patent Literature 1, a band-like pressure sensor (edge sensor) is disposed at a peripheral part (edge part) of a cymbal pad constituting a struck surface. When the edge part of the cymbal pad is gripped by a user and the edge sensor is turned on, choke control (mute control) of a musical sound that is being produced is performed. Patent Documents

[Patent Literature 1]

Japanese Patent Laid-Open Publication No. 2002-207481

[Patent Literature 2]

Japanese Patent Laid-Open Publication No. H09-311679

However, in an electronic cymbal, even if a user grips a cymbal pad, when a grip position is inside the inner circumference of the cymbal pad and the edge sensor is not disposed in this part, the edge sensor does not turn on. Therefore, it is not possible to perform choke control.

In addition, even if the edge part at which the edge sensor is disposed is gripped, the edge sensor may not turn on unless it is gripped strongly to some extent. Therefore, a user is forced to perform an operation different from choke playing with an acoustic cymbal or the like. In addition, it is not possible to realize playing such as touching the struck surface and muting as with an acoustic cymbal or the like.

In addition, in the electronic percussion instrument device in Patent Literature 2, a touch on a conductive striking component being detected and a signal of a musical sound that is produced being mute-controlled is described. However, in this electronic percussion instrument device, even if it can be detected whether a touch has occurred, it is difficult to detect a state (degree) of touching.

SUMMARY

The present invention has been made in order to solve the above problems, and an object of the present invention is to provide an electronic percussion instrument that can realize an operation similar to choke playing in an acoustic percussion instrument.

Solution to Problem

In order to achieve the above object, an electronic percussion instrument of the present invention includes a struck surface, a striking sensor configured to detect striking on the struck surface, and a sound production control unit configured to perform sound production control on a musical sound according to a detection result of the striking sensor. The electronic percussion instrument includes an electrostatic capacitance sensor having an electrode disposed on a side opposite to the struck surface, and an attenuation control unit configured to perform attenuation control to the musical sound that is being produced by the sound production control unit according to an output value of the electrostatic capacitance sensor.

According one of the embodiments of the disclosure, a sound production control method is provided. The method detects a strike on a struck surface of an electronic percussion instrument and performs sound production control on a musical sound according to detecting result of the strike. The method includes constructing at least one electrostatic capacitance sensor by forming an electrode on a side opposite to the struck surface, and an output value of the electrostatic capacitance sensor changes in accordance with a contact state of a touch by a user when the user touches the struck surface, and performing an attenuation control to the musical sound that is being produced according to the output value of the electrostatic capacitance sensor.

BRIEF DESCRIPTION OF THE DRAWINGS

FIG. 3(*b*) is a flowchart of a striking detection process.

FIG. 5(*b*) is a flowchart of a choke process.

FIG. 13(*b*) is a cross-sectional view of the electronic drum pad in the XIIIb part in FIG. 13(*a*).

FIG. 13(*c*) is a schematic view of the electronic drum pad in the XIIIc part in FIG. 13(*b*).

DESCRIPTION OF THE EMBODIMENTS

Figure 1:
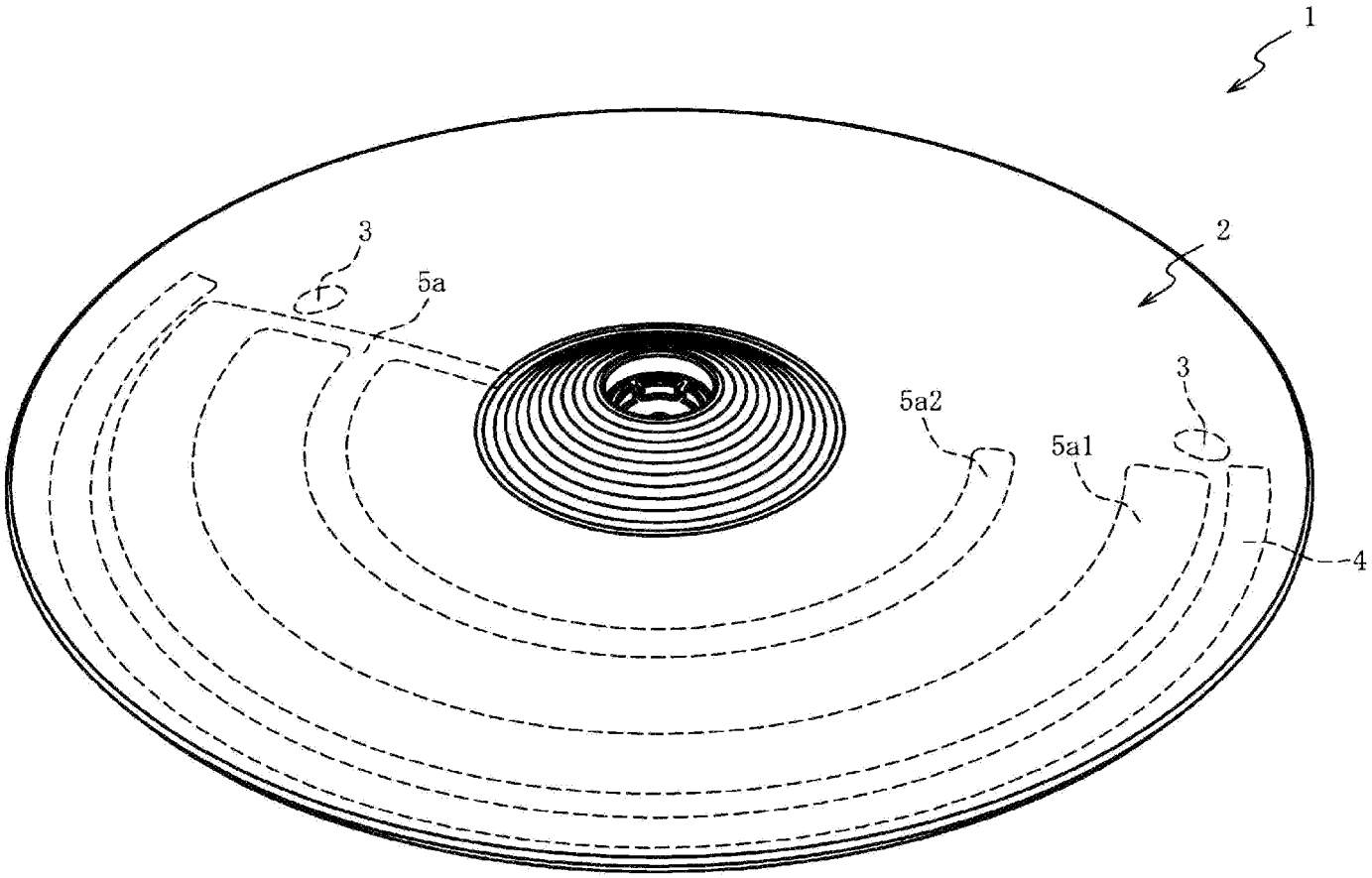
FIG. 1 is a perspective view of an electronic cymbal according to an embodiment of the present invention.

Preferable embodiments of the present invention will be described below with reference to the appended drawings. A first embodiment of the present invention will be described with reference to FIG. 1 to FIGS. 5(*a*) and 5(*b*). First, a schematic configuration of an electronic cymbal 1 as an electronic percussion instrument of the present invention will be described with reference to FIG. 1. FIG. 1 is a perspective view of the electronic cymbal 1 according to an embodiment of the present invention.

The electronic cymbal 1 includes a struck surface 2, a striking sensor 3, an edge sensor 4, and an electrostatic capacitance sensor 5. The struck surface 2 is formed of a disk-shaped rubber member which is struck by a user with a stick, and is formed to cover a disk-shaped plate (not shown) disposed on the side opposite to the struck surface 2.

The striking sensor 3 is a piezoelectric sensor configured to detect striking on the struck surface 2, and is disposed at two places on the disk-shaped plate disposed on the side opposite to the struck surface 2. When the struck surface 2 is hit by a user, the striking sensor 3 detects its vibration and transmits the strength of the vibration to a CPU 10 (refer to FIG. 2(*b*)) of the electronic cymbal 1. The CPU 10 calculates a velocity according to the strength of the vibration and generates a musical sound based on the calculated velocity.

The edge sensor 4 is a pressure sensor configured to detect that the outer circumferential part of the struck surface 2 is being gripped by the user, and is disposed along the outer circumference of the disk-shaped plate disposed on the side opposite to the struck surface 2. The edge sensor 4 transmits "1" in an "ON" state and "0" in an "OFF" state to the CPU 10. The CPU 10 performs attenuation control of a musical sound that is being produced in a condition in which the edge sensor 4 is in an "ON" state. Therefore, when the edge sensor 4 detects that the outer circumferential part of the struck surface 2 is being gripped by the user, it is possible to simulate choke playing in which a musical sound during playing is attenuated.

The electrostatic capacitance sensor 5 is a sensor configured to detect that a human body such as a user's hand is touching the struck surface 2, and an electrode 5*a* is disposed between the struck surface 2 and the disk-shaped plate disposed on the side opposite to the struck surface 2. The electrostatic capacitance sensor 5 transmits an increase or decrease (change) in a virtual electrostatic capacitance due to touch of a human body to the CPU 10. When approach of a human body is detected by the CPU 10 according to an output value of the electrostatic capacitance sensor 5, attenuation control of a musical sound that is being produced is performed. Therefore, according to the electrostatic capacitance sensor 5, when the user touches the struck surface 2, it is possible to simulate choke playing in which a musical sound during playing is attenuated. In order to reduce any influence on the electrostatic capacitance sensor 5, the struck surface 2 and the disk-shaped plate disposed on the side opposite to the struck surface 2 are formed of an insulator or a conductor that is not connected to a reference potential point or the electrostatic capacitance sensor 5.

Figure 2A:
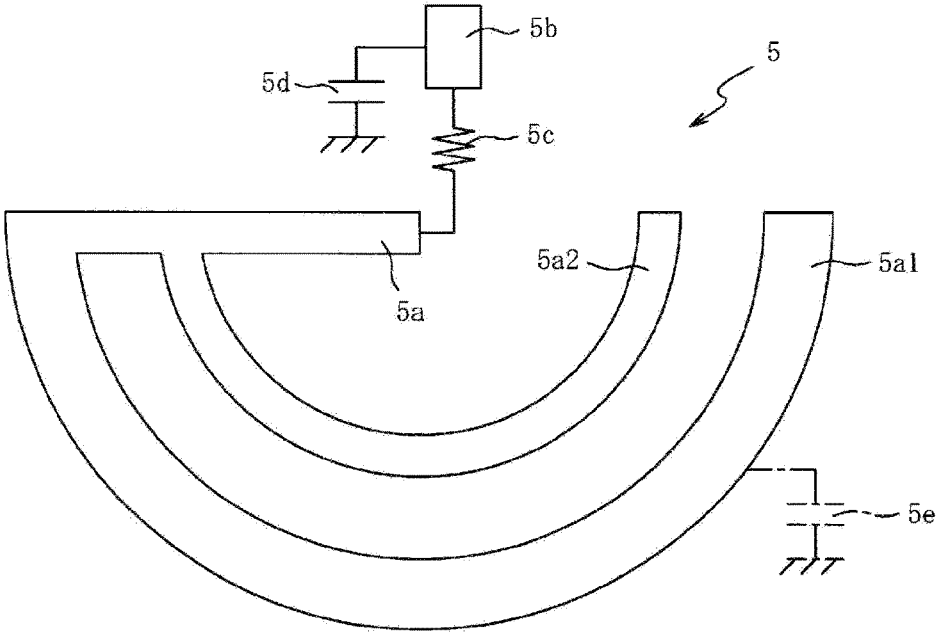
FIG. 2(*a*) is a diagram schematically showing an electrical configuration of an electrostatic capacitance sensor, and FIG. 2(*b*) is a block diagram showing an electrical configuration of an electronic cymbal.
Figure 2B:
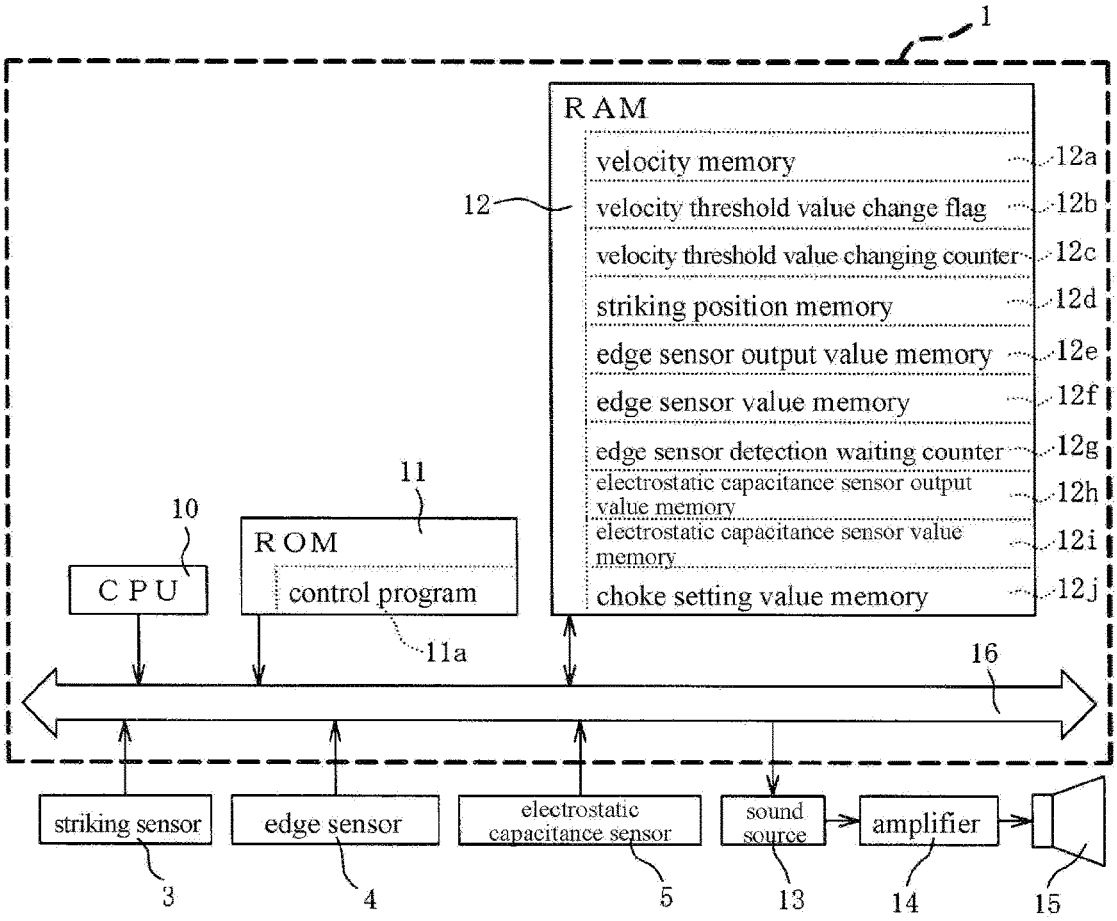

The electrostatic capacitance sensor 5 will be described with reference to FIG. 2(*a*). FIG. 2(*a*) is a diagram schematically showing an electrical configuration of the electrostatic capacitance sensor 5. A shown in FIG. 2(*a*), in the electrostatic capacitance sensor 5, the electrode 5*a* is connected to a control unit 5*b* via a resistor 5*c*. The electrode 5*a* is formed in two lines, a thick (large area) electrode 5*a*1 is disposed on the outer circumferential side and a thin (small area) electrode 5*a*2 is disposed on the inner circumferential side. The two lines of the electrodes 5*a*1 and 5*a*2 are connected to each other to form one electrode 5*a*.

The electrode 5*a* has a PET material laminated thereon. Therefore, even if striking by the user is transmitted to the electrode 5*a* through the struck surface 2, it is possible to prevent damage to the electrode 5*a*. In addition, the electrode 5*a* that is "freely movable" is adhered to the disk-shaped plate on the side opposite to the struck surface 2. That is, the entire surface of the electrode 5*a* is not adhered to the plate, but the electrode 5*a* is partially adhered to the plate. Therefore, even if the electrode 5*a* or the plate on the side opposite to the struck surface 2 expands or contracts due to change in temperature, it is possible to prevent damage such as breakage of the electrode 5*a* due to "free mobility."

The control unit 5*b* is a control circuit in which various switches, a CPU, and the like are mounted. The resistor 5*c* is an element for electrostatic protection. A sampling capacitor 5*d* is a capacitor used for repeatedly sending an electric charge charged into a parasitic capacitance capacitor 5*e* to be described below and measuring the number of repetitions until a voltage of the sampling capacitor 5*d* becomes a predetermined value or higher.

The parasitic capacitance capacitor 5*e* is a virtual capacitor formed between the electrode 5*a* and a conductor to be detected such as a human body. Since the human body has a large electrostatic capacitance, the electrostatic capacitance of the parasitic capacitance capacitor 5*e* increases as the human body approaches the electrode 5*a*. Therefore, an amount of electric charge charged into the parasitic capacitance capacitor 5*e* increases as the human body approaches the electrode 5*a*.

The electrostatic capacitance sensor 5 repeats a process of transmitting an electric charge to the electrode 5*a* according to a switching operation in the control unit 5*b*, charging the parasitic capacitance capacitor 5*e*, and sending the charged electric charge to the sampling capacitor 5*d*. The electrostatic capacitance sensor 5 detects change in the electrostatic capacitance of the parasitic capacitance capacitor 5*e* based on the number of repetitions until the voltage of the sampling capacitor 5*d* becomes a predetermined value or higher and determines whether a human body has approached the electrode 5*a*.

Here, as the electrostatic capacitance of the parasitic capacitance capacitor 5*e* becomes larger (as a distance between the electrode 5*a* and the human body becomes shorter), since an amount of electric charge sent from the parasitic capacitance capacitor 5*e* to the sampling capacitor 5*d* in one cycle becomes larger, the number of repetitions decreases. Since an output value of the electrostatic capacitance sensor 5 corresponding to the number of repetitions is output, it is possible to determine that a human body has approached the electrode 5*a* when the output value of the electrostatic capacitance sensor 5 is smaller. In the present embodiment, the electrostatic capacitance sensor 5 outputs a value of 650 to 850 according to the number of repetitions. In addition, a resistance value of the resistor 5*c* and an electrostatic capacitance of the sampling capacitor 5*d* may be appropriately set according to a desired performance. While the electrostatic capacitance sensor 5 of a general self-capacitance type has been described above, other types of electrostatic capacitance sensors may be used.

Next, an electrical configuration of the electronic cymbal 1 will be described with reference to FIG. 2(*b*). FIG. 2(*b*) is a block diagram showing an electrical configuration of the electronic cymbal 1. The electronic cymbal 1 includes the CPU 10, a ROM 11, a RAM 12, the striking sensor 3, the edge sensor 4, the electrostatic capacitance sensor 5, and a sound source 13, and these are connected to one another via a bus line 16. An amplifier 14 is connected to the sound source 13 and a speaker 15 is connected to the amplifier 14.

The CPU 10 is a computation device configured to control respective units connected via the bus line 16. The ROM 11 is a non-rewritable memory. In the ROM 11, a control program 11*a* executed by the CPU 10 and fixed value data (not shown) referred to by the CPU 10 when the control program 11*a* is executed are stored. When the control program 11*a* is executed by the CPU 10, a periodic process and a striking detection process in FIGS. 3(*a*) and 3(*b*) are performed.

The RAM 12 is a memory in which various types of work data, and flags and the like used when the CPU 10 executes a program such as the control program 11*a* are stored in a rewritable manner. In the RAM 12, a velocity memory 12*a*, a velocity threshold value change flag 12*b*, a velocity threshold value changing counter 12*c*, a striking position memory 12*d*, an edge sensor output value memory 12*e*, an edge sensor value memory 12*f*, an edge sensor detection waiting counter 12*g*, an electrostatic capacitance sensor output value memory 12*h*, an electrostatic capacitance sensor value memory 12*i*, and a choke setting value memory 12*j* are provided.

The velocity memory 12*a* is a memory in which a velocity of a musical sound calculated from the output value of the striking sensor 3 is stored. When power is supplied to the electronic cymbal 1, the state is initialized to "0" indicating that no velocity is stored. In the striking detection process in FIG. 3(*b*), a velocity is calculated based on the output value from the striking sensor 3, and is stored in the velocity memory 12*a* (FIG. 3(*b*), S5). Then, a musical sound corresponding to the velocity memory 12*a* is generated (FIG. 3(*b*), S8). The velocity memory 12*a* has a value in a range of 0 (weak) to 127 (strong) according to the strength of striking detected by the striking sensor 3.

The velocity threshold value change flag 12*b* is a flag for determining whether or not to change a threshold value of striking detection by the striking sensor 3 in a condition in which a human body has approached the struck surface 2. When power is supplied to the electronic cymbal 1 or when the periodic process in FIG. 3(*a*) is initialized (FIG. 3(*a*), S1), the state is initialized to "OFF" indicating that a threshold value of striking detection has not changed. In an electrostatic capacitance sensor process in FIG. 4, when the output value (that is, the value of the electrostatic capacitance sensor output value memory 12*h* to be described below) of the electrostatic capacitance sensor 5 is smaller than a velocity change threshold value to be described below and the value of the velocity threshold value changing counter 12*c* to be described below is shorter than a threshold value change time to be described below, the velocity threshold value change flag 12*b* is set to ON.

When choke playing due to touching the struck surface 2 is performed for a short time (when choke playing is quickly performed), touching the struck surface 2 with a user's hand may be erroneously detected as striking. Thus, in order to prevent such erroneous detection, in the electrostatic capacitance sensor process in FIG. 4, when the value of the electrostatic capacitance sensor output value memory 12*h* is smaller than the velocity change threshold value, the velocity threshold value change flag 12*b* is turned ON for the threshold value change time. In the striking detection process in FIG. 3(*b*), when the velocity threshold value change flag 12*b* is turned ON and the value of the velocity memory 12*a* is larger than a striking threshold value to be described below, a musical sound is produced and when the value of the velocity memory 12*a* is equal to or smaller than the striking threshold value, no musical sound is produced. In addition, when the velocity threshold value change flag 12*b* is OFF, even if the value of the velocity memory 12*a* is equal to or smaller than the striking threshold value, a musical sound is produced. That is, when the velocity threshold value change flag 12*b* is ON, the threshold value of the value of the velocity memory 12*a* for producing a musical sound becomes larger. Therefore, it is possible to prevent erroneous production of a musical sound due to impact on the struck surface 2 according to choke playing.

Figure 4:
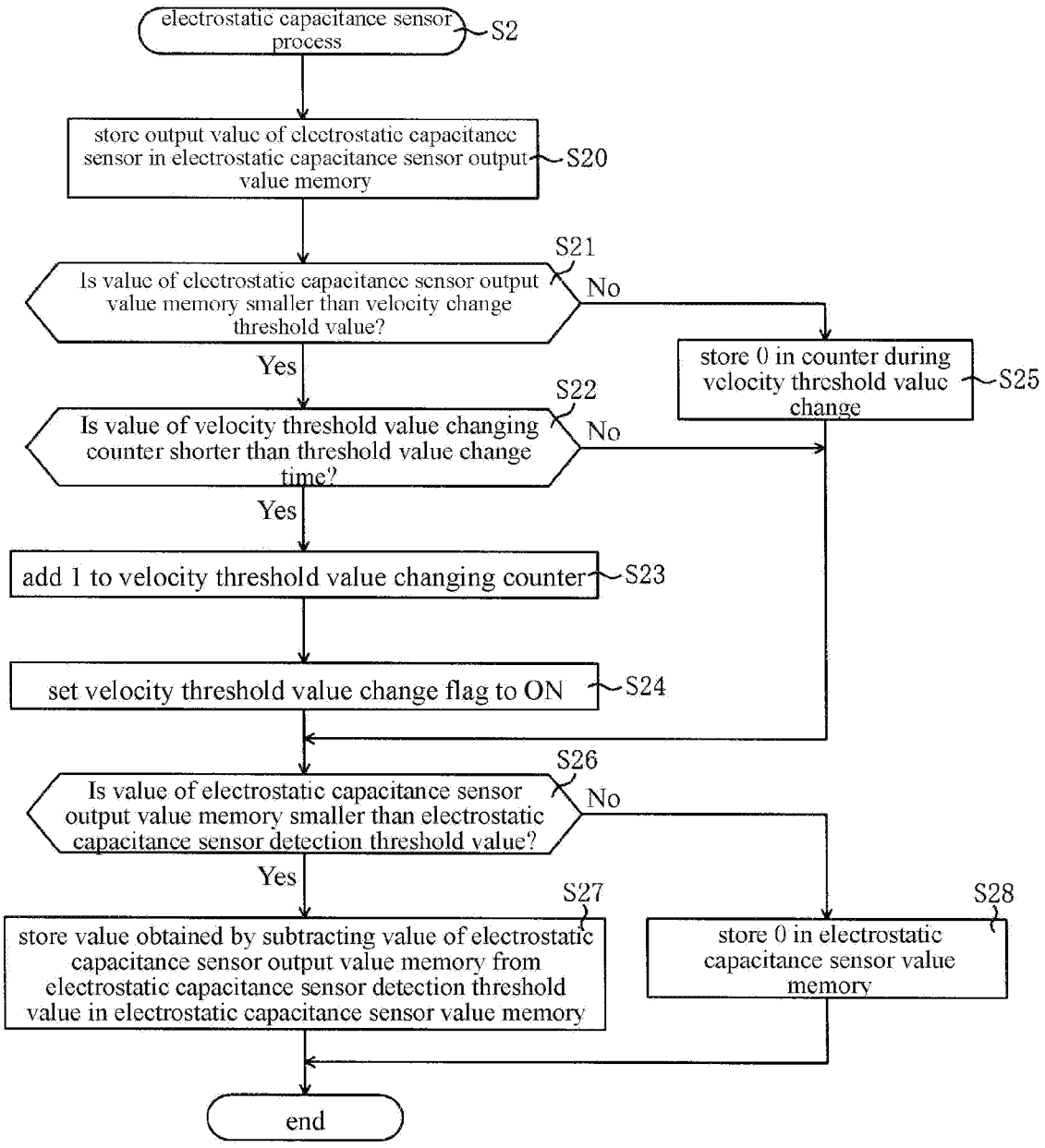
FIG. 4 is a flowchart of an electrostatic capacitance sensor process.

The velocity threshold value changing counter 12*c* is a counter that measures a duration time for which the velocity threshold value change flag 12*b* is ON. When power is supplied to the electronic cymbal 1 or in the electrostatic capacitance sensor process in FIG. 4, if the value of the electrostatic capacitance sensor output value memory 12*h* is equal to or larger than the velocity change threshold value, "0" is set (FIG. 4, S25). When the value of the electrostatic capacitance sensor output value memory 12*h* is smaller than the velocity change threshold value, 1 is added to the velocity threshold value changing counter 12*c* (FIG. 4, S23). That is, when the velocity threshold value change flag 12*b* is switched from OFF to ON, 1 is periodically added to the value of the velocity threshold value changing counter 12*c*. The velocity threshold value change flag 12*b* is turned OFF when the value of the velocity threshold value changing counter 12*c* is equal to or larger than the threshold value change time to be described below. A threshold value of the value of the velocity memory 12*a* for producing a musical sound is changed by the velocity threshold value changing counter 12*c* for a certain time (that is, for the threshold value change time). Therefore, when a hand holding a stick is brought into contact with the struck surface 2 and performs playing, if the threshold value change time has passed, since the threshold value of the value of the velocity memory 12*a* for producing a musical sound is returned to its original value, it is possible to reduce a feeling of discomfort in playing to a minimum.

The striking position memory 12*d* is a memory in which a striking position for the musical sound calculated from the output value of the striking sensor 3 is stored. When power is supplied to the electronic cymbal 1, the state is initialized to "0" indicating that no striking position is stored. In the striking detection process in FIG. 3(*b*), a striking position is calculated based on the output value from the striking sensor 3, and is stored in the striking position memory 12*d* (FIG. 3(*b*), S5). In the present embodiment, the striking position is a distance from the center of the struck surface 2. Then, a musical sound corresponding to the striking position memory 12*d* is generated (FIG. 3(*b*), S8).

The edge sensor output value memory 12*e* is a memory in which a sensor output value from the edge sensor 4 is stored. When power is supplied to the electronic cymbal 1 or immediately after the periodic process in FIG. 3(*a*) starts, the state is initialized to "0" indicating that the edge sensor 4 is not detected. Then, in an edge sensor process in FIG. 5(*a*), the output value of the edge sensor 4 is stored (FIG. 5(*a*), S30). In the present embodiment, when the edge sensor 4 is detected, "1" is output from the edge sensor 4, and when the edge sensor 4 is not detected, "0" is output. That is, when the value of the edge sensor output value memory 12*e* is "0," this indicates that the edge sensor 4 is not detected, and when the value of the edge sensor output value memory 12*e* is "1," this indicates that the edge sensor 4 is detected.

The edge sensor value memory 12*f* is a memory in which an ON/OFF state of the edge sensor 4 is stored. When power is supplied to the electronic cymbal 1, the state is initialized to "0" indicating that the edge sensor 4 is OFF. When the edge sensor output value memory 12*e* is "1" and the edge sensor detection waiting counter 12*g* to be described below is equal to or longer than a detection waiting time, "1" is set in the edge sensor value memory 12*f*.

The ON/OFF state of the edge sensor 4 is determined by the edge sensor value memory 12*f* in order to prevent unintended choke playing due to chattering of the edge sensor 4 or the like. In the electronic cymbal 1, a user grasps (grips) the edge sensor 4 with his or her finger and thereby performs choke playing. When the user tries to grip the edge sensor 4 during playing, he or she may accidentally touch the edge sensor 4 during playing. In such a case, when the sensor output value of the edge sensor 4 is directly used as choke playing information, unintended choke playing may be performed. In order to prevent this playing, the edge sensor value memory 12*f* becomes "1" only when the edge sensor output value memory 12*e* is "1" and the edge sensor detection waiting counter 12*g* to be described below is a detection waiting time or longer. Therefore, after the output value of the edge sensor 4 is stabilized, the ON/OFF state of the edge sensor 4 used in choke playing is determined, and thus unintended choke playing can be prevented. According to results obtained by calculating values of the edge sensor value memory 12*f* and the electrostatic capacitance sensor value memory 12*i* to be described below, attenuation control of a musical sound that is being produced (that is, a choke process) is performed.

Figure 5A:
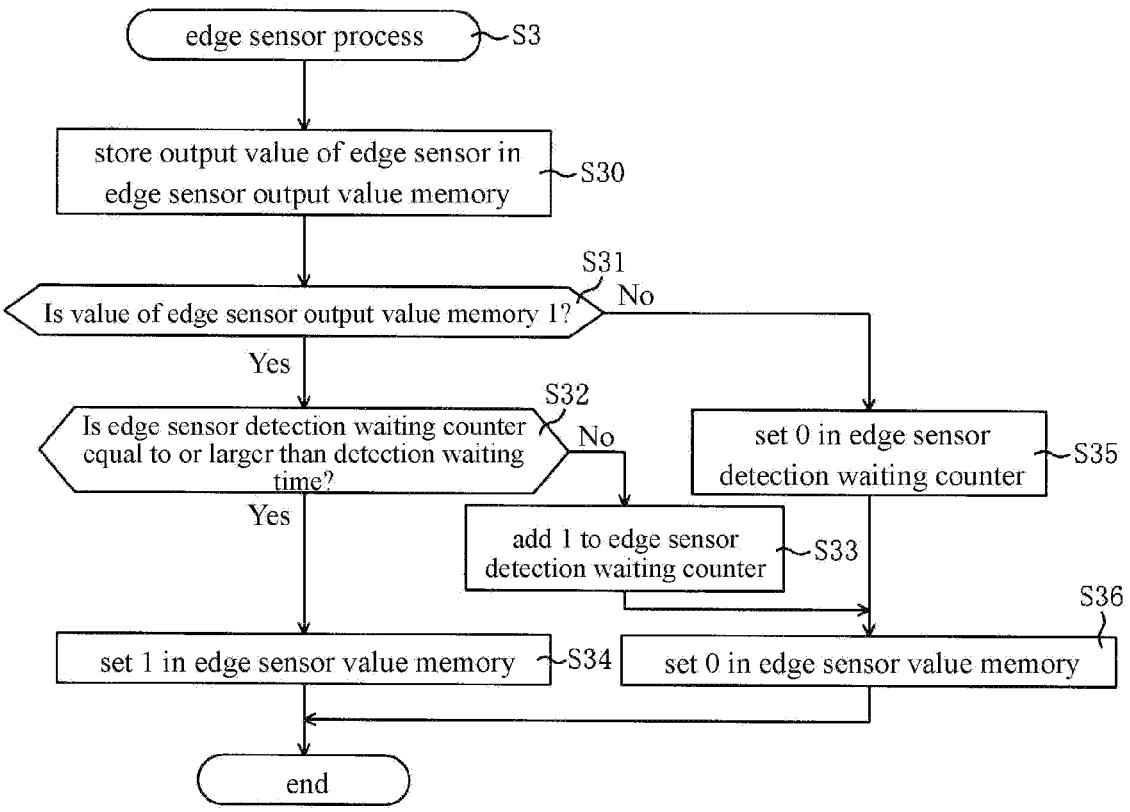
FIG. 5(*a*) is a flowchart of an edge sensor process.
Figure 5B:
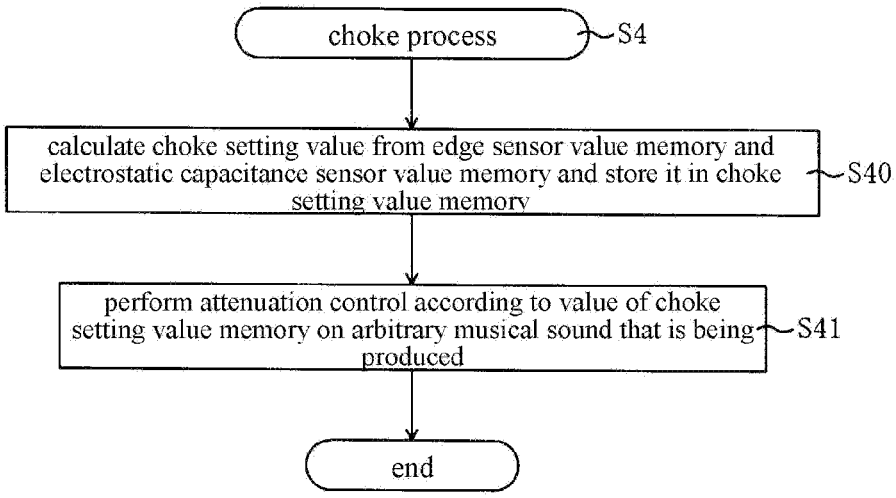

The edge sensor detection waiting counter 12*g* is a counter that measures a duration time for which the sensor output value of the edge sensor 4 is "1." When power is supplied to the electronic cymbal 1 or in the edge sensor process in FIG. 5(*a*), if the value of the edge sensor output value memory 12*e* is "0," "0" is set (FIG. 5(*a*), S35). When the value of the edge sensor output value memory 12*e* is "1" and the value of the edge sensor detection waiting counter 12*g* is shorter than the detection waiting time to be described below, 1 is added to the edge sensor detection waiting counter 12*g* (FIG. 5(*a*), S33). That is, a time from when the value of the edge sensor output value memory 12*e* becomes "1" until the detection waiting time elapses is measured by the edge sensor detection waiting counter 12*g*.

The electrostatic capacitance sensor output value memory 12*h* is a memory in which the sensor output value from the electrostatic capacitance sensor 5 is stored. When power is supplied to the electronic cymbal 1 or immediately after the periodic process in FIG. 3(*a*) starts, the state is initialized to "0" indicating that the electrostatic capacitance sensor 5 is not detected. Then, when the electrostatic capacitance sensor process in FIG. 4 is initialized, the output value of the electrostatic capacitance sensor 5 is stored (FIG. 4, S20).

The electrostatic capacitance sensor value memory 12*i* is a memory in which the sensor value of the electrostatic capacitance sensor 5 calculated based on the electrostatic capacitance sensor output value memory 12*h* is stored. When power is supplied to the electronic cymbal 1 or in the electrostatic capacitance sensor process in FIG. 4, if the value of the electrostatic capacitance sensor output value memory 12*h* is equal to or larger than an electrostatic capacitance sensor detection threshold value to be described below, "0" indicating that the electrostatic capacitance sensor 5 is not detected is set. In the electrostatic capacitance sensor process in FIG. 4, when the value of the electrostatic capacitance sensor output value memory 12*h* is smaller than the electrostatic capacitance sensor detection threshold value, a value obtained by subtracting the value of the electrostatic capacitance sensor output value memory 12*h* from the electrostatic capacitance sensor detection threshold value is stored in the electrostatic capacitance sensor value memory 12*i* (FIG. 4, S27). That is, a difference between the electrostatic capacitance sensor output value memory 12*h* and the electrostatic capacitance sensor detection threshold value is stored in the electrostatic capacitance sensor value memory 12*i*. According to the result obtained by computing the value of the electrostatic capacitance sensor value memory 12*i* and the value of the edge sensor value memory 12*f*, attenuation control of a musical sound that is being produced (that is, the choke process) is performed.

The choke setting value memory 12*j* is a memory in which an attenuation setting value in the choke process for a musical sound that is being produced is stored. When power is supplied to the electronic cymbal 1 or immediately after the choke process in FIG. 5(*b*) starts, "0" indicating that no attenuation control is performed is set. Then, in the choke process in FIG. 5(*b*), an attenuation setting value obtained by weighting the value of the edge sensor detection waiting counter 12*g* and the value of the electrostatic capacitance sensor value memory 12*i* is stored in the choke setting value memory 12*j* (FIG. 5(*b*), S40). The electronic cymbal 1 performs attenuation control according to the value of the choke setting value memory 12*j* on an arbitrary musical sound that is being produced and thus simulates choke playing.

The sound source 13 is a device that controls tones and various effects of a musical sound generated according to an instruction from the CPU 10. The amplifier 14 is a device that amplifies a musical sound signal generated in the sound source 13 and outputs the amplified musical sound signal to the speaker 15. The speaker 15 emits (outputs) the musical sound signal amplified by the amplifier 14 as a musical sound.

Figure 3A:
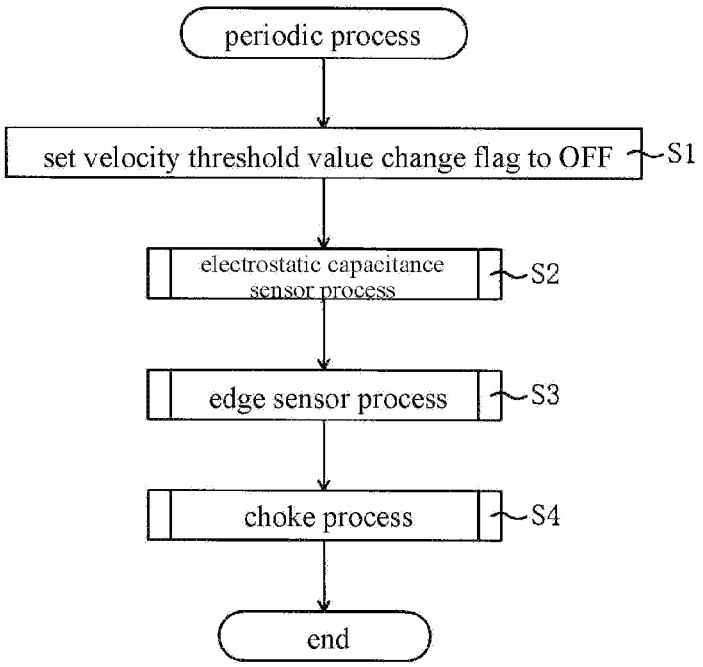
FIG. 3(*a*) is a flowchart of a periodic process.
Figure 3B:
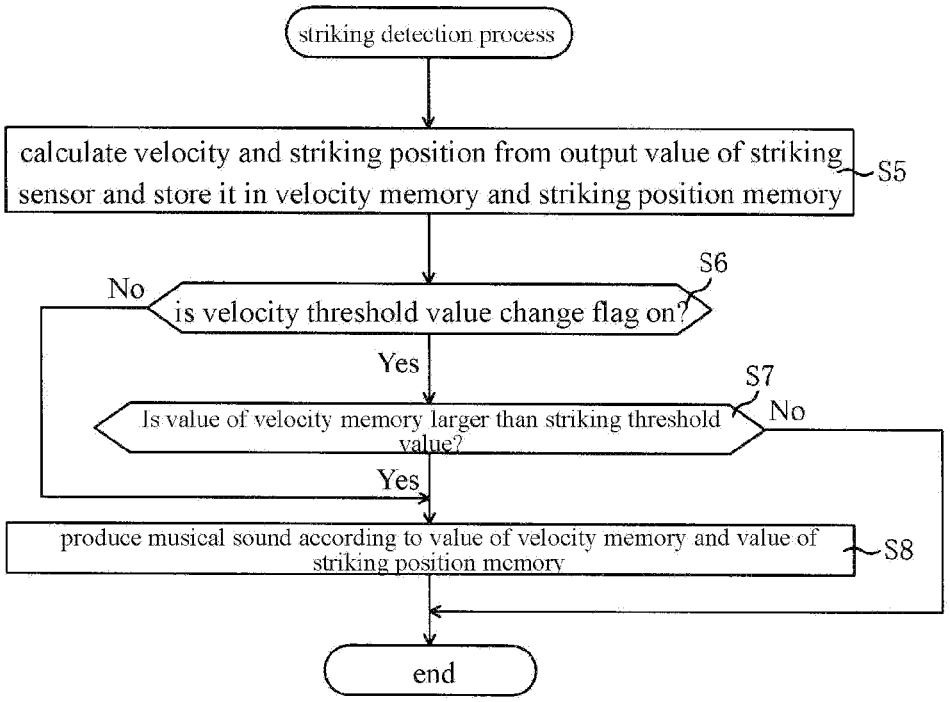

Next, a control program executed by the CPU 10 of the electronic cymbal 1 will be described with reference to FIGS. 3(*a*) and 3(*b*) to FIGS. 5(*a*) and 5(*b*). FIG. 3(*a*) is a flowchart of the periodic process. States of the edge sensor 4 and the electrostatic capacitance sensor 5 are acquired, and the choke process is performed on an arbitrary musical sound that is being produced according to the states of the sensors. According to a detection state of the electrostatic capacitance sensor 5, and according to choke playing or the like, it is determined whether the user is in contact with the struck surface 2. The periodic process is repeatedly performed every 100 μsec according to an interval interrupting process every 100 μsec.

First, the velocity threshold value change flag 12*b* is set to OFF (S1). In the electrostatic capacitance sensor process to be described below (S2), since the velocity threshold value change flag 12*b* is set to ON according to the output value of the electrostatic capacitance sensor 5, the velocity threshold value change flag 12*b* is set to OFF when the periodic process repeatedly performed is initialized. After the process of S1, the electrostatic capacitance sensor process is performed (S2). The electrostatic capacitance sensor process will be described with reference to FIG. 4.

FIG. 4 is a flowchart of the electrostatic capacitance sensor process. In the electrostatic capacitance sensor process, an output value of the electrostatic capacitance sensor 5 is acquired, and it is determined whether or not to change a threshold value of striking detection by the striking sensor 3 according to the output value of the electrostatic capacitance sensor 5. In addition, a sensor value of the electrostatic capacitance sensor 5 used in the choke process in FIG. 5(*b*) is calculated from the output value of the electrostatic capacitance sensor 5, and is stored in the electrostatic capacitance sensor value memory 12*i*.

First, in the electrostatic capacitance sensor process, the output value of the electrostatic capacitance sensor 5 is stored in the electrostatic capacitance sensor output value memory 12*h* (S20). After the process of S20, it is checked whether the value of the electrostatic capacitance sensor output value memory 12*h* is smaller than the velocity change threshold value (for example, 820) (S21). The velocity change threshold value is set according to an output value from the electrostatic capacitance sensor 5 when a human body lightly touches the struck surface 2. The velocity change threshold value may be set to 820 or more or 820 or less according to a detection ability (sensitivity) of the electrostatic capacitance sensor 5 and a material of the struck surface 2.

When the value of the electrostatic capacitance sensor output value memory 12*h* is smaller than the velocity change threshold value (Yes in S21), it is checked whether the velocity threshold value changing counter 12*c* is smaller than the threshold value change time (for example, 5,000, that is, 0.5 seconds) (S22). When the velocity threshold value changing counter 12*c* is shorter than the threshold value change time (Yes in S22), 1 is added to the velocity threshold value changing counter 12*c* (S23), and the velocity threshold value change flag 12*b* is set to ON (S24). On the other hand, when the velocity threshold value changing counter 12*c* is equal to or larger than the threshold value change time (No in S22), the processes of S22 to S24 are skipped.

When the value of the electrostatic capacitance sensor output value memory 12*h* is smaller than the velocity change threshold value, the velocity threshold value change flag 12*b* is set to ON during the threshold value change time. On the other hand, when the velocity threshold value changing counter 12*c* is equal to or larger than the threshold value change time, the velocity threshold value change flag 12*b* is set to OFF. Since the value of the threshold value change time is 5,000, and the electrostatic capacitance sensor process is performed every 100 μsec, a time during which the velocity threshold value change flag 12*b* is ON is a maximum of 0.5 seconds. In the striking detection process to be described below, if the velocity threshold value change flag 12*b* is ON, the threshold value of the value of the velocity memory 12*a* for producing a musical sound becomes larger. Therefore, it is possible to prevent production of a musical sound due to impact on the struck surface 2 according to choke playing. In addition, since the threshold value of the value of the velocity memory 12*a* for producing a musical sound returns to its original value after 0.5 seconds, it is possible to reduce a feeling of discomfort in the subsequent play operation to a minimum. Here, the value of the threshold value change time may be set to 5,000 or more or 5,000 or less as long as no feeling of discomfort is given in the play operation.

When the value of the electrostatic capacitance sensor output value memory 12*h* is equal to or larger than the velocity change threshold value (No in S21), 0 is stored in the velocity threshold value changing counter 12*c*, and the processes of S22 to S24 are skipped. That is, since the value of the electrostatic capacitance sensor output value memory 12*h* is equal to or larger than the velocity change threshold value, it indicates that the human body is away from the electrostatic capacitance sensor 5. Therefore, 0 is stored in the velocity threshold value changing counter 12*c* to prepare a case in which the human body approaches the electrostatic capacitance sensor 5 next time.

After the processes of S24 and S25, it is checked whether the value of the electrostatic capacitance sensor output value memory 12*h* is smaller than the electrostatic capacitance sensor detection threshold value (for example, 790) (S26). When the value of the electrostatic capacitance sensor output value memory 12*h* is smaller than the electrostatic capacitance sensor detection threshold value (Yes in S26), a value obtained by subtracting the value of the electrostatic capacitance sensor output value memory 12*h* from the electrostatic capacitance sensor detection threshold value is stored in the electrostatic capacitance sensor value memory 12*i* (S27). That is, a difference between the electrostatic capacitance sensor detection threshold value and the value of the electrostatic capacitance sensor output value memory 12*h* is stored in the electrostatic capacitance sensor value memory 12*i*. Based on the electrostatic capacitance sensor value memory 12*i*, in the choke process in FIG. 5(*b*), attenuation control of a musical sound that is being produced is performed.

On the other hand, when the value of the electrostatic capacitance sensor output value memory 12*h* is equal to or larger than the electrostatic capacitance sensor detection threshold value (No in S26), 0 is stored in the electrostatic capacitance sensor value memory 12*i* (S28). After the processes of S27 and S28, the electrostatic capacitance sensor process ends, and the process returns to the periodic process in FIG. 3(*a*).

Returns to FIG. 3(*a*). After the electrostatic capacitance sensor process (S2) is performed, the edge sensor process (S3) is performed. Details of the edge sensor process will be described with reference to FIG. 5(*a*). FIG. 5(*a*) is a flowchart of the edge sensor process. In the edge sensor process, a sensor value of the edge sensor 4 used in the choke process in FIG. 5(*b*) is calculated from an output value of the edge sensor 4, and is stored in the edge sensor value memory 12*f*. First, the output value of the edge sensor 4 is acquired and is stored in the edge sensor output value memory 12*e* (S30). When the edge sensor 4 is in an "ON" state, "1" is stored in the edge sensor output value memory 12*e*, and when the edge sensor 4 is in an "OFF" state, "0" is stored.

After the process of S30, it is checked whether the value of the edge sensor output value memory 12*e* is "1" (S31). When the value of the edge sensor output value memory 12*e* is "1" (Yes in S31), that is, when the edge sensor 4 is in an "ON" state, it is checked whether the edge sensor detection waiting counter 12*g* is equal to or larger than a detection waiting time (for example, 500, that is, 0.05 seconds) (S32). When the edge sensor detection waiting counter 12*g* is equal to larger than the detection waiting time (Yes in S32), 1 is set in the edge sensor value memory 12*f* (S34). On the other hand, when the edge sensor detection waiting counter 12*g* is shorter than the detection waiting time (No in S32), 1 is added to the edge sensor detection waiting counter 12*g* (S33), and 0 is set in the edge sensor value memory 12*f* (S36).

Since the value of the detection waiting time is 500, and the edge sensor process is performed every 100 μsec, when the "ON" state of the edge sensor 4 continues for 0.05 seconds or longer, 1 is set in the edge sensor value memory 12*f*. This is to prevent unintended choke playing due to chattering of the edge sensor 4 or the like. When the "ON" state of the edge sensor 4 continues for 0.05 seconds, since it can be determined that the "ON" state is stable, 1 is set in the edge sensor value memory 12*f* at this time. Therefore, after the output value of the edge sensor 4 is stabilized, since the ON/OFF state of the edge sensor 4 used in choke playing is determined (that is, the value of the edge sensor value memory 12*f* is changed), unintended choke playing can be prevented.

In the process of S31, when the value of the edge sensor output value memory 12*e* is not "1" (No in S31), 0 is set in the edge sensor detection waiting counter 12*g* (S35), and 0 is set in the edge sensor value memory 12*f* (S36). That is, since the edge sensor 4 is in an OFF state, 0 is set in the edge sensor detection waiting counter 12*g* to prepare a case in which the edge sensor 4 is turned on ON next time. After the processes of S34 and S36, the edge sensor process ends, and the process returns to the periodic process in FIG. 3(*a*).

Returns to FIG. 3(*a*). After the edge sensor process (S3) is performed, the choke process (S4) is performed. In the choke process, an attenuation process is performed on a musical sound that is being produced according to the value of the edge sensor value memory 12*f* and the value of the electrostatic capacitance sensor value memory 12*i*.

First, a choke setting value is calculated from the value of the edge sensor value memory 12*f* and the value of the electrostatic capacitance sensor value memory 12*i* and is stored in the choke setting value memory 12*j* (S40). Specifically, a result obtained by weighting the value of the edge sensor value memory 12*f* and the value of the electrostatic capacitance sensor value memory 12*i* is stored in the choke setting value memory 12*j*. The weighting operation is expressed by the following equation 1.

[Math. 1]

$$\text{Value_}CK=\text{Value_}ED*Coef_ED+\text{Value_}CS*Coef_CS \quad \text{Equation (1)}$$

Here, Value_CK is a choke setting value. Value_ED is a value of the edge sensor value memory 12*f*. Value_CS is a value of the electrostatic capacitance sensor value memory 12*i*. Coef_ED and Coef_CS are weighting components for the value of the edge sensor value memory 12*f* and the value of the electrostatic capacitance sensor value memory 12*i*. Coef_ED is "64", and Coef_CS is "0.9." According to the weighting computation in Equation 1, a choke setting value according to the value of the edge sensor value memory 12*f* and the value of the electrostatic capacitance sensor value memory 12*i* is calculated and the choke setting value is used in an attenuation process for a musical sound that is being produced.

After the process of S40, attenuation control according to the value of the choke setting value memory 12*j* is performed on an arbitrary musical sound that is being produced (S41). After the process of S41, the choke process ends, and the process returns to the periodic process in FIG. 3(*a*). The periodic process ends after the choke process (S4) is performed.

Next, the striking detection process will be described with reference to FIG. 3(*b*). FIG. 3(*b*) is a flowchart of the striking detection process. In the striking detection process, when the striking sensor 3 detects that the struck surface 2 is struck, a striking position and a velocity are calculated from the output value of the striking sensor 3 and a musical sound according to the striking position and the velocity is produced. In addition, according to the ON/OFF state of the velocity threshold value change flag 12*b*, a magnitude of the velocity at which a musical sound is produced, that is, the threshold value of striking detection, is changed. The striking detection process is performed according to an interrupting process triggered by the fact that the striking sensor 3 detects striking.

First, a velocity and a striking position are calculated from the output value of the striking sensor 3 and stored in the velocity memory 12*a* and the striking position memory 12*d* (S5). Specifically, the waveform of the output value of the striking sensor 3 is analyzed, its striking strength (velocity) and a striking position (a distance from the center of the struck surface 2) are estimated, and stored in the velocity memory 12*a* and the striking position memory 12*d*.

After the process of S5, it is checked whether the velocity threshold value change flag 12*b* is ON (S6). When the velocity threshold value change flag 12*b* is ON (Yes in S6), it is checked whether the value of the velocity memory 12*a* is larger than the striking threshold value (for example, 10) (S7). When the value of the velocity memory 12*a* is larger than the striking threshold value (Yes in S7), a musical sound according to the value of the velocity memory 12*a* and the value of the striking position memory 12*d* is produced (S8). On the other hand, when the value of the velocity memory 12*a* is equal to or lower than the striking threshold value (No in S7), the process of S8 is skipped. That is, when a human body approaches the electrostatic capacitance sensor 5 and during the threshold value change time (0.5 seconds), if the value of the velocity memory 12*a* is larger than the striking threshold value, a musical sound is produced and if the value of the velocity memory 12*a* is equal to or smaller than the striking threshold value, no musical sound is produced.

In the process of S6, when the velocity threshold value change flag 12*b* is not ON (No in S6), the process of S7 is skipped and a musical sound according to the value of the velocity memory 12*a* and the value of the striking position memory 12*d* is produced (S8). After the processes of S7 and S8, the striking detection process ends.

According to the electronic cymbal 1 of the first embodiment, when striking on the struck surface 2 is detected by the striking sensor 3, production of a musical sound is controlled according to the detection result. While the musical sound is being produced, for example, when the user touches the struck surface 2, an output value corresponding to the contact state is output from the electrostatic capacitance sensor 5 and attenuation control of a musical sound that is being produced is performed according to the output value. Therefore, according to the contact state of the user with respect to the struck surface 2, it is possible to perform attenuation control of a musical sound that is being produced. Therefore, it is possible to realize a musical sound mute process according to an operation similar to choke playing in an acoustic cymbal in which the user touches the struck surface 2.

In addition, in this method, the struck surface 2 is interposed between the electrode 5*a* of the electrostatic capacitance sensor 5 and the user, and approach of the user's hand is detected according to change in the output value of the electrostatic capacitance sensor 5. Therefore, even when the user touches the struck surface 2 in which the electrode 5*a* of the electrostatic capacitance sensor 5 is not disposed, the touch is detected by the electrode 5*a* disposed near the position touched by the user, it is possible to perform attenuation control of a musical sound that is being produced.

When it is detected that the user's hand approaches the struck surface 2 according to the output value of the electrostatic capacitance sensor 5, a threshold value for striking detection by the striking sensor 3 is changed to a value (that is, the striking threshold value) higher than a general threshold value. Therefore, even if impact occurs on the struck surface 2 due to quick choke playing, in such a case, the threshold value of the velocity for producing a musical sound by the striking sensor 3 is changed to a value higher than the general threshold value. Therefore, it is possible to prevent erroneously detecting such a choke operation as striking.

The electrode 5*a* of the electrostatic capacitance sensor 5 is disposed between the struck surface 2 and the disk-shaped plate disposed on the side opposite to the struck surface 2. Therefore, the appearance of the struck surface 2 is not impaired by the electrode 5*a*. In addition, since it is possible to avoid direct striking of the electrode 5*a*, it is possible to prevent deterioration of durability of the electrode 5*a*.

In addition, the electrode 5*a* is configured as two electrodes 5*a*1 and 5*a*2 disposed on the outer circumferential side and the inner circumferential side, and these are connected to each other to form one electrode 5*a*. Therefore, it is possible to reduce a difference between output values of the electrostatic capacitance sensor 5 when the struck surface 2 is choked with the palm of the hand and when the struck surface 2 is gripped lightly and choked. Therefore, it is possible to recognize that "the hand touched," in both choke operations," that is, it is possible to recognize both choke operations and it is possible to perform attenuation control of a musical sound that is being produced.

In addition, the electrode 5*a*1 on the outer circumferential side and the electrode 5*a*2 on the inner circumferential side are formed in different areas. Therefore, since the output value of the electrostatic capacitance sensor 5 is different between when the user touches the outer circumferential side (end side) of the struck surface 2 and when the user touches the inner circumferential side of the struck surface 2, it is possible to recognize the touches distinctly. Therefore, it is possible to perform attenuation control of a musical sound that is being produced according to a touched part.

Next, a second embodiment of the present invention will be described with reference to FIGS. 6 to 9(*a*) and 9(*b*). In the above first embodiment, approach of the human body is detected by one electrostatic capacitance sensor 5, the choke process is performed according to the output value of the electrostatic capacitance sensor 5, and a threshold value for striking detection by the striking sensor 3 is changed. In the second embodiment, with two electrostatic capacitance sensors 5 and 6, the choke process is performed and a threshold value for striking detection by the striking sensor 3 is changed. In the second embodiment, parts the same as those in the above first embodiment will be denoted with the same reference numerals and descriptions thereof will be omitted.

Figure 6:
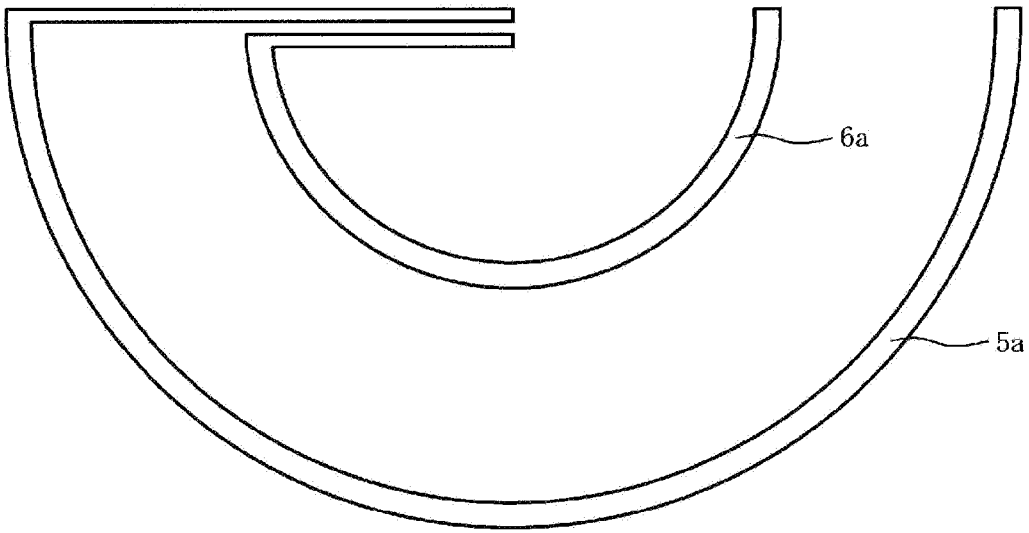
FIG. 6 is a diagram showing an electrostatic capacitance sensor according to a second embodiment.

FIG. 6 is a diagram showing the electrostatic capacitance sensors 5 and 6 of the second embodiment. As shown in FIG. 6, the electrode 5*a* of the electrostatic capacitance sensor 5 is disposed on the outer circumferential side of the struck surface 2. In addition, an electrode 6*a* of the second electrostatic capacitance sensor 6 is disposed on the inner circumferential side of the struck surface 2. The electrode 5*a* and the electrode 6*a* are formed in a single line. In addition, since the configurations of the electrostatic capacitance sensor 5 and the second electrostatic capacitance sensor 6 are the same as that of the electrostatic capacitance sensor 5 of the first embodiment, descriptions thereof will be omitted. In the electronic cymbal 1 of the second embodiment, approach of the human body on the outer circumferential side of the struck surface 2 is detected by the electrostatic capacitance sensor 5, and approach of the human body on the inner circumferential side of the struck surface 2 is detected by the electrostatic capacitance sensor 6.

Figure 7:
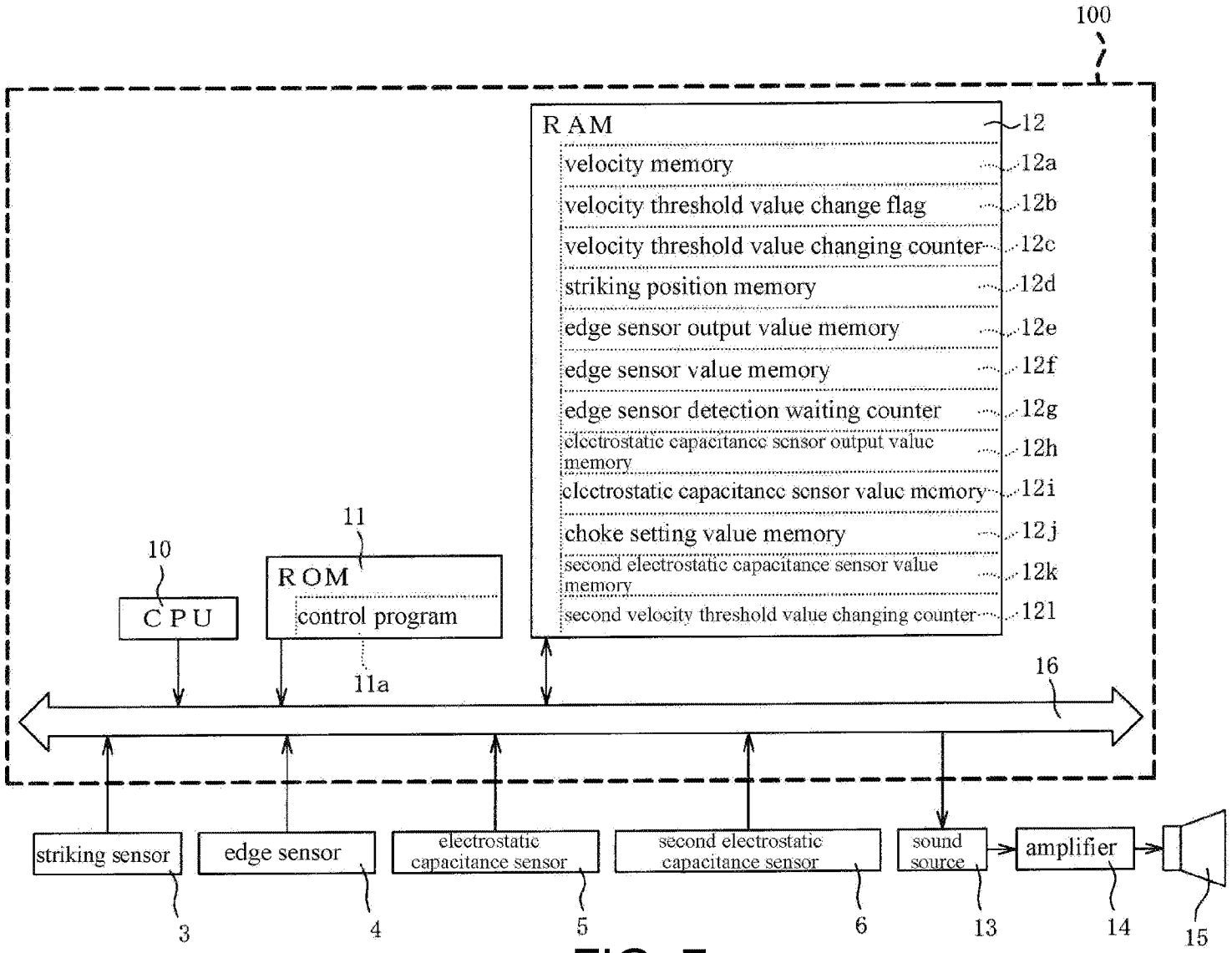
FIG. 7 is a block diagram showing an electrical configuration of an electronic cymbal according to the second embodiment.

FIG. 7 is a block diagram showing an electrical configuration of an electronic cymbal 100 of the second embodiment. The electronic cymbal 100 includes the CPU 10, the ROM 11, the RAM 12, the striking sensor 3, the edge sensor 4, the electrostatic capacitance sensor 5, the second electrostatic capacitance sensor 6, and the sound source 13, and these are connected to one another via the bus line 16. The amplifier 14 is connected to the sound source 13, and the speaker 15 is connected to the amplifier 14.

The RAM 12 is a memory in which various types of work data, flags and the like used when the CPU 10 executes a program such as the control program 11*a* are stored in a rewritable manner. In the RAM 12, the velocity memory 12*a*, the velocity threshold value change flag 12*b*, the velocity threshold value changing counter 12*c*, the striking position memory 12*d*, the edge sensor output value memory 12*e*, the edge sensor value memory 12*f*, the edge sensor detection waiting counter 12*g*, the electrostatic capacitance sensor output value memory 12*h*, the electrostatic capacitance sensor value memory 12*i*, the choke setting value memory 12*j*, a second electrostatic capacitance sensor value memory 12*k*, and a second velocity threshold value changing counter 12*l* are provided.

The second electrostatic capacitance sensor value memory 12*k* is a memory in which a sensor value of the second electrostatic capacitance sensor 6 calculated based on the electrostatic capacitance sensor output value memory 12*h* is stored. When power is supplied to the electronic cymbal 100 or in a second electrostatic capacitance sensor process in FIGS. 9(*a*) and 9(*b*), if the value of the electrostatic capacitance sensor output value memory 12*h* is equal to or larger than an electrostatic capacitance sensor detection threshold value, the state is set to "0" indicating that the second electrostatic capacitance sensor 6 is not detected (FIG. 9(*a*), S98). In the second electrostatic capacitance sensor process in FIGS. 9(*a*) and 9(*b*), when the value of the electrostatic capacitance sensor output value memory 12*h* is smaller than the electrostatic capacitance sensor detection threshold value, a value obtained by subtracting the value of the electrostatic capacitance sensor output value memory 12*h* from the electrostatic capacitance sensor detection threshold value is stored in the second electrostatic capacitance sensor value memory 12*k* (FIG. 9(*a*), S97). According to the result obtained by computing the value of the second electrostatic capacitance sensor value memory 12*k*, the value of the electrostatic capacitance sensor value memory 12*i*, and the value of the edge sensor value memory 12*f*, attenuation control of a musical sound that is being produced is performed.

The second velocity threshold value changing counter 12*l* is a counter that measures a duration time for which the velocity threshold value change flag 12*b* is ON according to the state of the second electrostatic capacitance sensor 6. When power is supplied to the electronic cymbal 100 or in the second electrostatic capacitance sensor process in FIGS. 9(*a*) and 9(*b*), if the value of the electrostatic capacitance sensor output value memory 12*h* is equal to or larger than the velocity change threshold value, "0" is set (FIG. 9(*a*), S95). When the value of the electrostatic capacitance sensor output value memory 12*h* is smaller than the velocity change threshold value, 1 is added to the second velocity threshold value changing counter 12*l* (FIG. 4, S93). That is, when the velocity threshold value change flag 12*b* is changed from OFF to ON, 1 is periodically added to the value of the second velocity threshold value changing counter 12*l*. The velocity threshold value change flag 12*b* is turned OFF when the value of the second velocity threshold value changing counter 12*l* is equal to or larger than the threshold value change time.

Figure 8:
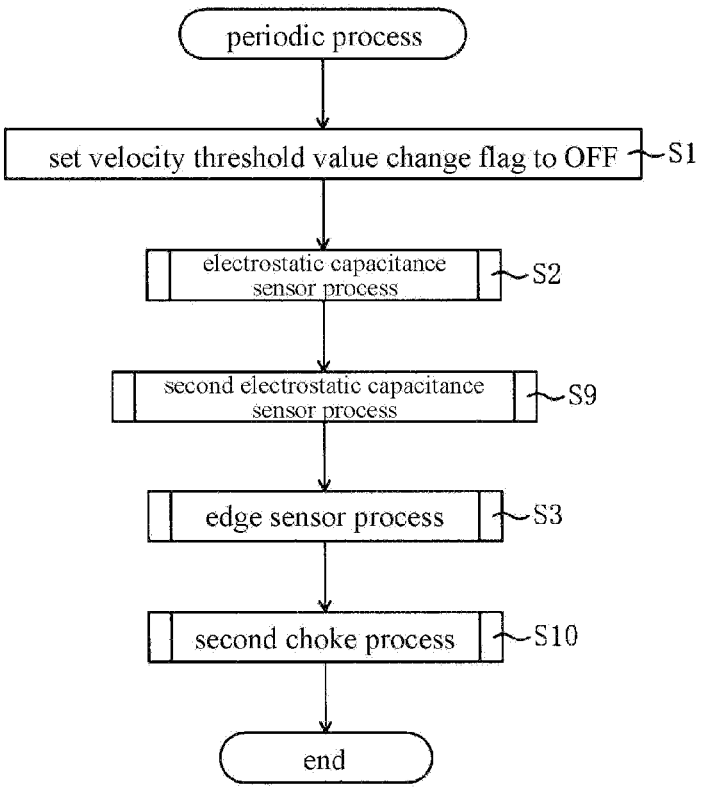
FIG. 8 is a flowchart of a periodic process according to the second embodiment.

Next, a control program executed by the CPU 10 in the electronic cymbal 100 of the second embodiment will be described with reference to FIG. 8 and FIGS. 9(*a*) and 9(*b*). FIG. 8 is a flowchart of the periodic process. First, the velocity threshold value change flag 12*b* is set to OFF (S1), and the electrostatic capacitance sensor process (S2) is performed. After the process of S2, the second electrostatic capacitance sensor process (S9) is performed. The second electrostatic capacitance sensor process will be described with reference to FIG. 9(*a*).

Figure 9A:
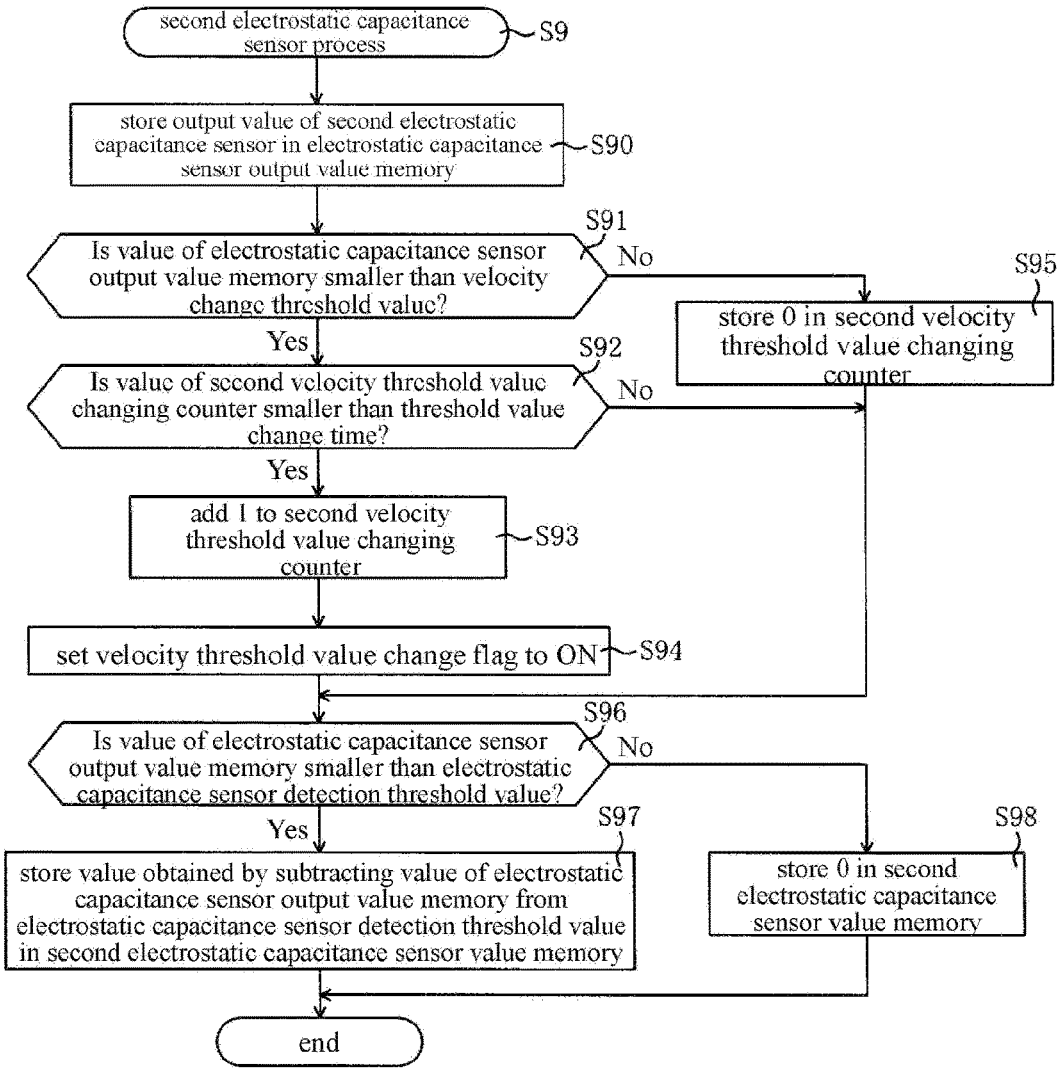
FIG. 9(*a*) is a flowchart of a second electrostatic capacitance sensor process according to the second embodiment and FIG. 9(*b*) is a flowchart of a second choke process according to the second embodiment.
Figure 9B:
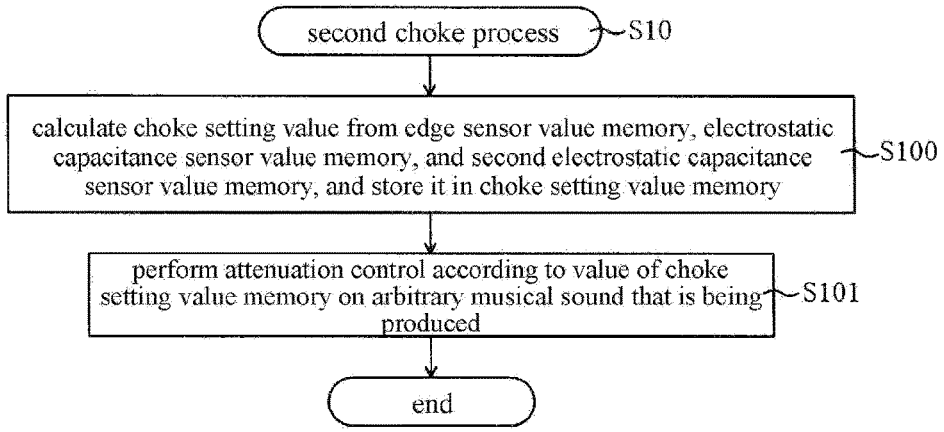

FIG. 9(*a*) is a flowchart of the second electrostatic capacitance sensor process. In the second electrostatic capacitance sensor process, an output value of the second electrostatic capacitance sensor 6 is acquired, and it is determined whether or not to change a threshold value of the striking detection by the striking sensor 3 according to the output value of the second electrostatic capacitance sensor 6. In addition, a sensor value of the second electrostatic capacitance sensor 6 used in the choke process in FIG. 5(*b*) is calculated from the output value of the second electrostatic capacitance sensor 6, and is stored in the second electrostatic capacitance sensor value memory 12*k*.

First, in the second electrostatic capacitance sensor process, the output value of the second electrostatic capacitance sensor 6 is stored in the electrostatic capacitance sensor output value memory 12*h* (S90). After the process of S90, it is checked whether the value of the electrostatic capacitance sensor output value memory 12*h* is smaller than the velocity change threshold value (S91). When the value of the electrostatic capacitance sensor output value memory 12*h* is smaller than the velocity change threshold value (Yes in S91), it is checked whether the second velocity threshold value changing counter 12*l* is smaller than the threshold value change time (S92). When the second velocity threshold value changing counter 12*l* is shorter than the threshold value change time (Yes in S92), 1 is added to the second velocity threshold value changing counter 12*l* (S93), and the velocity threshold value change flag 12*b* is set to ON (S94). On the other hand, when the second velocity threshold value changing counter 12*l* is equal to or larger than the threshold value change time (No in S92), the processes of S93 to S94 are skipped.

When the value of the electrostatic capacitance sensor output value memory 12*h* is equal to or larger than the velocity change threshold value (No in S91), 0 is stored in the second velocity threshold value changing counter 12*l*, and the processes of S92 to S94 are skipped. That is, since the value of the electrostatic capacitance sensor output value memory 12*h* is equal to or larger than the velocity change threshold value, it indicates that the human body is away from the second electrostatic capacitance sensor 6. Therefore, 0 is stored in the second velocity threshold value changing counter 12*l* to prepare a case in which the human body approaches the second electrostatic capacitance sensor 6.

After the processes of S94 and S95, it is checked whether the value of the electrostatic capacitance sensor output value memory 12*h* is smaller than the electrostatic capacitance sensor detection threshold value (S96). When the value of the electrostatic capacitance sensor output value memory 12*h* is smaller than the electrostatic capacitance sensor detection threshold value (Yes in S96), a value obtained by subtracting the value of the electrostatic capacitance sensor output value memory 12*h* from the electrostatic capacitance sensor detection threshold value is stored in the second electrostatic capacitance sensor value memory 12*k* (S97). That is, a difference between the electrostatic capacitance sensor detection threshold value and the value of the electrostatic capacitance sensor output value memory 12*h* is stored in the second electrostatic capacitance sensor value memory 12*k*. Based on the second electrostatic capacitance sensor value memory 12*k*, in a second choke process in FIG. 9(*b*), attenuation control of a musical sound that is being produced is performed.

On the other hand, when the value of the electrostatic capacitance sensor output value memory 12*h* is equal to or larger than the electrostatic capacitance sensor detection threshold value (No in S96), 0 is stored in the second electrostatic capacitance sensor value memory 12*k* (S98). After the processes of S97 and S98, the second electrostatic capacitance sensor process ends, and the process returns to the periodic process in FIG. 8.

Returns to FIG. 8. After the second electrostatic capacitance sensor process (S9) is performed, the edge sensor process (S3) is performed. After the process of S3, the second choke process (S10) is performed. In the second choke process, an attenuation process is performed on a musical sound that is being produced according to the value of the edge sensor value memory 12*f*, the value of the electrostatic capacitance sensor value memory 12*i*, and the value of the second electrostatic capacitance sensor value memory 12*k*.

First, a choke setting value is calculated from the value of the edge sensor value memory 12*f*, the value of the electrostatic capacitance sensor value memory 12*i*, and the value of the second electrostatic capacitance sensor value memory 12*k*, and is stored in the choke setting value memory 12*j* (S100). Specifically, a result obtained by weighting the value of the edge sensor value memory 12*f*, the value of the electrostatic capacitance sensor value memory 12*i*, and the value of the second electrostatic capacitance sensor value memory 12*k* is stored in the choke setting value memory 12*j*. The weighting operation is expressed by the following equation 2.

[Math. 2]

$$\text{Value_}CK=\text{Value_}ED*Coef_ED+\text{Value_}CS*Coef_CS+\text{Value_}CS2*Coef_CS2 \quad \text{Equation(2)}$$

Here, Value_CK is a choke setting value. Value_ED is a value of the edge sensor value memory 12*f*. Value_CS is a value of the electrostatic capacitance sensor value memory 12*i*. Value_CS2 is a value of the second electrostatic capacitance sensor value memory 12*k*. Coef_ED, Coef_CS, and Coef_CS2 are weighting components for the value of the edge sensor value memory 12*f*, the value of the electrostatic capacitance sensor value memory 12*i*, and the value of the second electrostatic capacitance sensor value memory 12*k*. Coef_ED is "64," Coef_CS is "0.45," and Coef_CS2 is "0.45." According to the weighting computation in Equation 2, a choke setting value according to the value of the edge sensor value memory 12*f*, the value of the electrostatic capacitance sensor value memory 12*i*, and the value of the second electrostatic capacitance sensor value memory 12*k* is calculated, and the choke setting value is used in an attenuation process for a musical sound that is being produced.

After the process of S100, attenuation control according to the value of the choke setting value memory 12*j* is performed on an arbitrary musical sound that is being produced (S101). After the process of S101, the choke process ends, and the process returns to the periodic process in FIG. 8. The periodic process ends after the second choke process (S10) is performed.

According to the electronic cymbal 100 of the second embodiment, since the electrostatic capacitance sensor 5 is disposed on the outer circumferential side of the struck surface 2 and the second electrostatic capacitance sensor 6 is disposed on the inner circumferential side of the struck surface 2, it is possible to distinctly determine whether the user's hand approaches the outer circumferential side or the inner circumferential side of the struck surface 2. Therefore, musical sound attenuation control can be changed according to the position on the struck surface 2 in which the user touches with the two electrostatic capacitance sensors 5 and 6.

While the present invention has been described above with reference to the embodiments, the present invention is not limited to the above embodiments, and it can be easily understood that various improvements and modifications can be made within a range without departing from the spirit and scope of the present invention.

Figure 10:
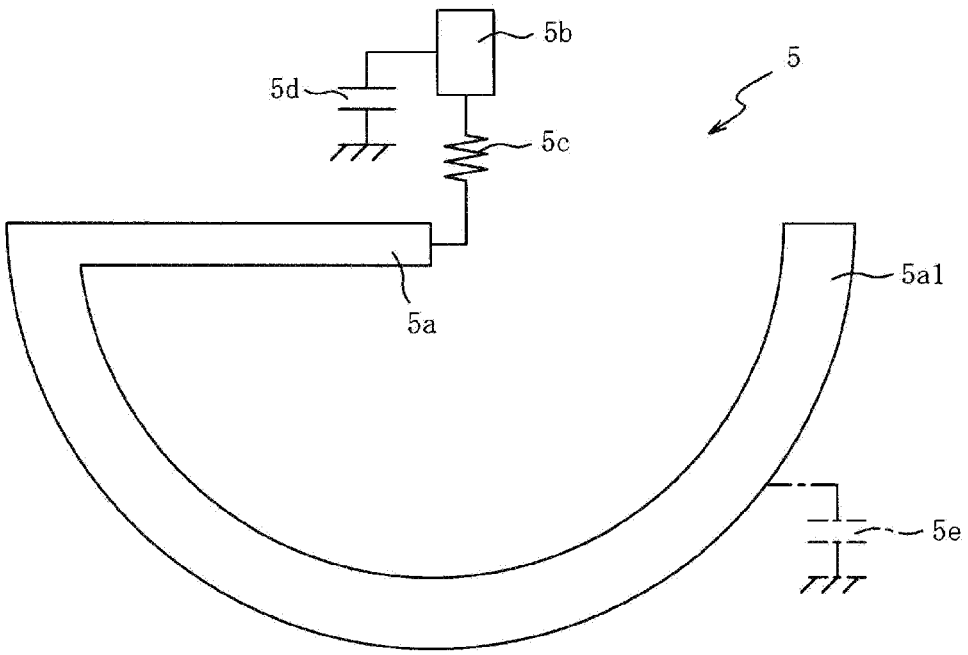
FIG. 10 is a diagram showing a shape of an electrode of an electrostatic capacitance sensor according to a modified example.
Figure 11A:
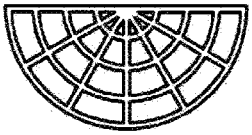
FIGS. 11(*a*)~11(*j*) are diagrams showing shapes of electrodes of an electrostatic capacitance sensor in a modified example.
Figure 11B:
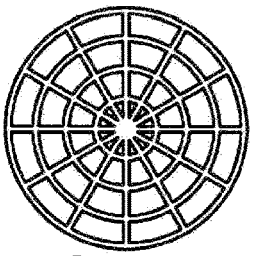
Figure 11C:
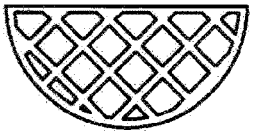
Figure 11D:
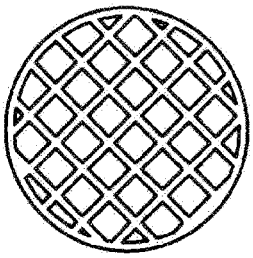
Figure 11E:
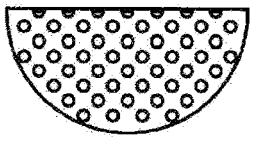
Figure 11F:
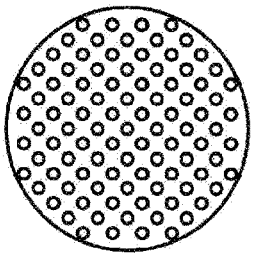
Figure 11G:
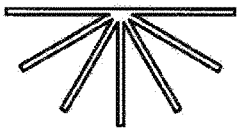
Figure 11H:
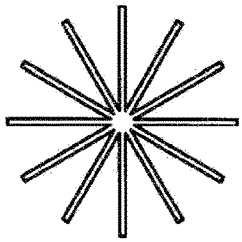
Figure 11I:
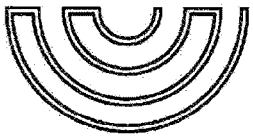
Figure 11J:
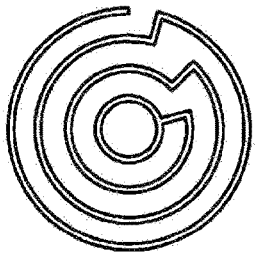

In the first embodiment, the electrode 5*a* of the electrostatic capacitance sensor 5 has a configuration in which the thick electrode 5*a*1 is disposed on the outer circumferential side and the thin electrode 5*a*2 is disposed on the inner circumferential side. However, the electrode 5*a* is not necessarily limited to such a shape, and other shapes can be appropriately used. For example, as shown in FIG. 10, the electrode 5*a* may be configured with only the electrode 5*a*1 on the outer circumferential side without the electrode 5*a*2 on the inner circumferential side. When the electrode 5*a* is formed in a single line in this manner, the electrode can be easily produced.

Figure 12A:
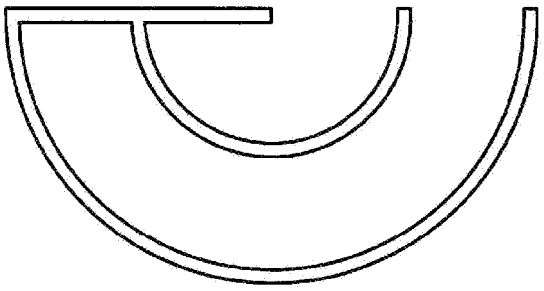
FIGS. 12(*a*)~12(*c*) are diagrams showing shapes of electrodes of an electrostatic capacitance sensor in a modified example.
Figure 12B:
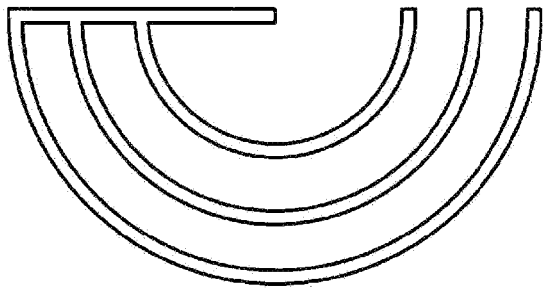
Figure 12C:
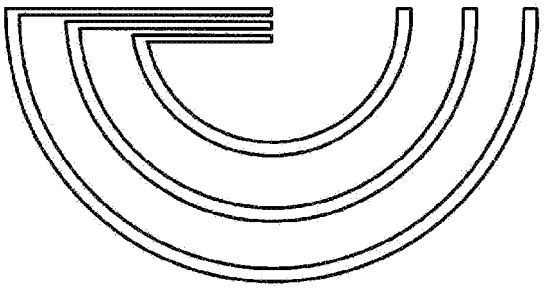

In addition, as shown in FIGS. 11(*a*)~11(*j*) and FIGS. 12(*a*)~12(*c*), the electrode 5*a* of the electrostatic capacitance sensor 5 may be formed. As shown in FIGS. 11(*a*)~11(*j*), examples of other shapes of the electrode 5*a* include a shape in which the electrode 5*a* is disposed in the shape of "spider's web" (perforated shape) (FIG. 11(*a*)), a shape in which the electrode 5*a* is disposed in the shape of "mesh" (FIG. 11(*c*)), a shape in which holes are provided at equal intervals in the electrode 5*a* (perforated shape) (FIG. 11(*e*)), a shape in which the electrode 5*a* is provided radially from the center (a plurality of lines) (FIG. 11(*g*)), and a shape in which arcs of the plurality of electrodes 5*a* are connected in the shape of "one stroke" (a plurality of lines) from the inner circumferential side to the outer circumferential side (FIG. 11(*i*)). In addition, the electrode 5*a* is not limited to a semicircular shape and it may be an entire circular shape. FIG. 11(*b*), FIG. 11(*d*), FIG. 11(*f*), FIG. 11(*h*), and FIG. 11(*j*) are entire circular shapes of FIG. 11(*a*), FIG. 11(*c*), FIG. 11(*e*), FIG. 11(*g*), and FIG. 11(*i*).

Since the electrode 5*a* of the electrostatic capacitance sensor 5 is formed in a plurality of lines, a mesh shape, or a perforated shape, it is possible to reduce a difference between output values of the electrostatic capacitance sensor 5 when the struck surface 2 is choked with the palm of the hand and when the struck surface 2 is gripped lightly and choked. Therefore, it is possible to recognize that "the hand touched," in both choke operations," that is, it is possible to recognize both choke operations and it is possible to perform attenuation control of a musical sound that is being produced.

In addition, in FIG. 11(*a*) to FIG. 11(*j*), the electrode may have a shape with different areas on the inner circumferential side and the outer circumferential side. Accordingly, since the output value of the electrostatic capacitance sensor 5 is different between when the user touches the outer circumferential side (end side) of the struck surface 2 and when the user touches the inner circumferential side of the struck surface 2, it is possible to recognize the touches distinctly. Therefore, it is possible to perform attenuation control of a musical sound that is being produced according to a touched part.

In the first embodiment, a configuration in which a thick electrode is disposed on the outer circumferential side and a thin electrode is disposed on the inner circumferential side is used. However, as shown in FIGS. 12(*a*) and 12(*b*), the thickness of the electrode 5*a* of the electrostatic capacitance sensor 5 may be the same on the outer circumferential side and the inner circumferential side.

In addition, in the first embodiment, approach of the human body is detected by one electrostatic capacitance sensor 5. In the second embodiment, approach of the human body is detected by two of the electrostatic capacitance sensor 5 and the second electrostatic capacitance sensor 6. However, the present invention is not necessarily limited thereto, as shown in FIG. 12(*c*), in addition to the outer circumferential side and the inner circumferential side, an electrostatic capacitance sensor is additionally provided therebetween, and a choke operation may be detected by a total of three electrostatic capacitance sensors. In this case, a process in which a sensor value of the third electrostatic capacitance sensor is acquired, and the velocity threshold value change flag 12*b* is turned ON or OFF according to the sensor value (that is, a process corresponding to the second electrostatic capacitance sensor process) and a process in which musical sound attenuation control including a sensor value of the third electrostatic capacitance sensor is performed (that is, a process corresponding to the second choke process) are added. Here, of course, a choke operation may be detected by four or more electrostatic capacitance sensors.

In the present embodiment, the electronic cymbals 1 and 100 have been described as an electronic percussion instrument including an electrostatic capacitance sensor. However, the present invention is not necessarily limited thereto, and may be applied to other electronic percussion instruments. As an example, an electronic drum pad 20 shown in FIGS. 13(*a*)~13(*c*) is exemplified.

Figure 13B:
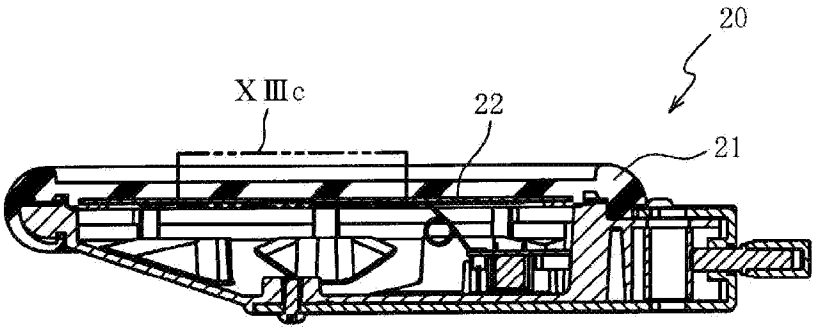
FIG. 13(*a*) is a front view of an electronic drum pad in a modified example.
Figure 13C:
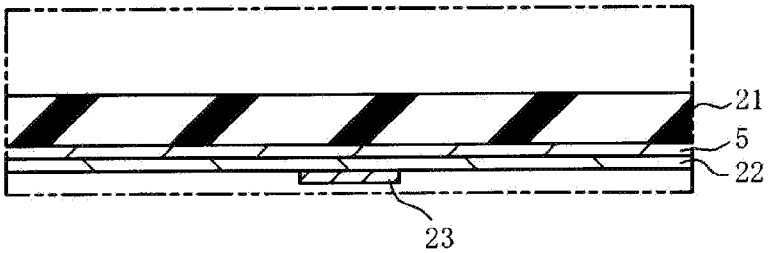
Figure 13A:
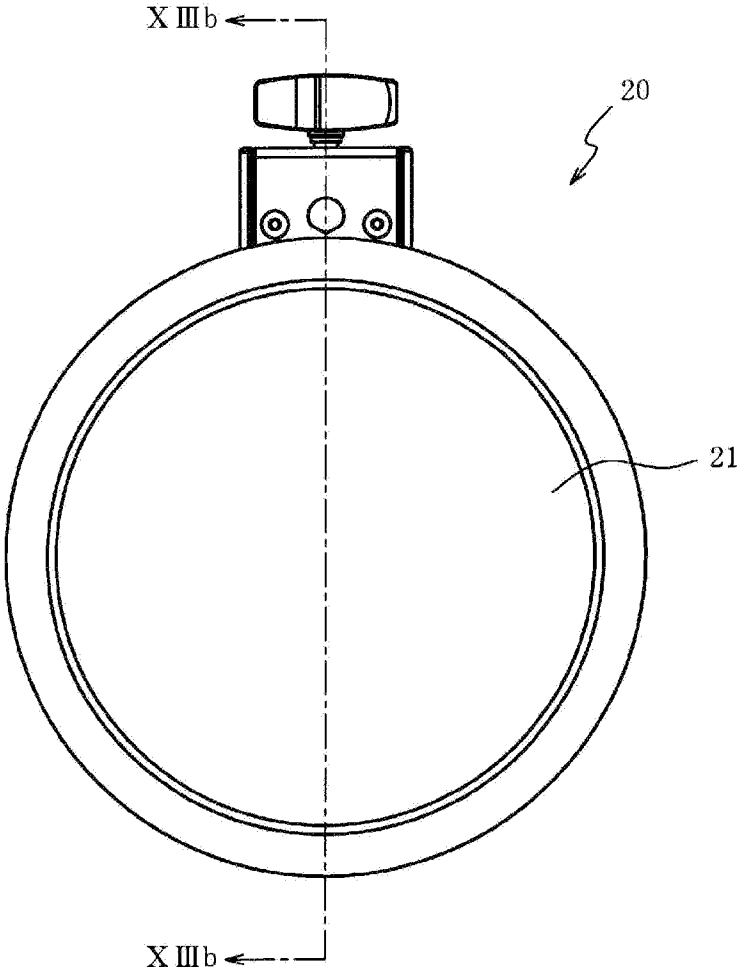

FIG. 13(*a*) is a front view of the electronic drum pad 20 of a modified example. FIG. 13(*b*) is a cross-sectional view of the electronic drum pad 20 in the XIIIb part in FIG. 13(*a*). FIG. 13(*c*) is a schematic view of the electronic drum pad 20 in the XIIIc part in FIG. 13(*b*). A rubber struck surface 21 is disposed at the center of the electronic drum pad 20. A steel plate 22 is disposed below the struck surface 21, and the electrostatic capacitance sensor 5 is disposed between the struck surface 21 and the steel plate 22. A striking sensor 23 is disposed below the steel plate 22. The striking sensor 23 is a piezoelectric sensor for detecting striking. When the user strikes the struck surface 21, the impact is transmitted to the striking sensor 23 through the steel plate 22 and the striking is detected. A musical sound is produced according to the detection result. However, when it is determined that the struck surface 21 is touched with a hand, the musical sound that is being produced is muted (silenced).

In an electronic drum pad including no electrostatic capacitance sensor 5 of the related art, when striking is repeated, static electricity (that is, electric charge) accumulates in the vicinity of the struck surface 21 and the steel plate 22. When this static electricity is transmitted to the striking sensor 23, a sound source (not shown) connected to the striking sensor 23 may malfunction or be erroneously operated. In order to prevent this, the steel plate 22 is grounded, and thus static electricity in the vicinity of the struck surface 21 and the steel plate 22 is omitted. Here, the electrostatic capacitance sensor 5 can repeatedly send electric charges. Therefore, in the electronic drum pad 20 of this modified example, when the electrostatic capacitance sensor 5 is superimposed on the steel plate 22, since electric charges accumulated in the steel plate 22 are also periodically sent, and accumulation of electric charges does not continue, it is not necessary to ground the steel plate 22. Therefore, it is possible to reduce the number of components of the electronic drum pad 20.

Here, in this modified example, a configuration in which the electrostatic capacitance sensor 5 is superimposed on the steel plate 22 is used. However, a configuration in which the steel plate 22 is used as the electrode 5*a* of the electrostatic capacitance sensor 5 may be used.

In the present embodiment, a choke operation is recognized according to detection results of the edge sensor 4, the electrostatic capacitance sensor 5, and the second electrostatic capacitance sensor 6. However, the present invention is not necessarily limited thereto, and a configuration in which the edge sensor 4 is not provided and a choke operation is recognized using only the electrostatic capacitance sensor 5 and the second electrostatic capacitance sensor 6 may be used. In this case, the edge sensor output value memory 12*e*, the edge sensor value memory 12*f*, and the edge sensor detection waiting counter 12*g* are unnecessary. In addition, execution of the edge sensor process in FIG. 5(*a*) is not necessary. In this case, in S40 of the edge sensor process in FIG. 5(*b*) and S100 of the second edge sensor process in FIG. 9(*b*), Coef_CS and Coef_CS2, that is, weighting component values for the value of the electrostatic capacitance sensor value memory 12*i* and the value of the second electrostatic capacitance sensor value memory 12*k*, may be appropriately changed.

What is claimed is:

1. An electronic percussion instrument, which is an electronic cymbal configured to perform playing, comprising a struck surface, and a sound production control unit configured to perform sound production control on a musical sound according to a detection result of a striking on the struck surface, wherein the electronic percussion instrument comprises:

at least one electrostatic capacitance sensor having an electrode disposed on a side opposite to the struck surface, and a control unit configured to perform attenuation control to the musical sound that is being produced by the sound production control unit according to an output value of the electrostatic capacitance sensor, and when a hand is detected approaching the struck surface according to the output value of the electrostatic capacitance sensor, the control unit attenuates the musical sound during playing.

2. The electronic percussion instrument according to claim 1, wherein one electrode of the electrostatic capacitance sensor is formed in a plurality of lines.

3. The electronic percussion instrument according to claim 2, wherein the one electrode formed in the plurality of lines is disposed on an inner circumferential side and an outer circumferential side of the side opposite to the struck surface, and a line of the one electrode on the inner circumferential side and a line of the one electrode on the outer circumferential side are formed in different areas.

4. The electronic percussion instrument according to claim 1, wherein the at least one electrostatic capacitance sensor is a plurality of electrostatic capacitance sensors, the electrode of one of the plurality of electrostatic capacitance sensors is disposed on an inner circumferential side of the side opposite to the struck surface, and other electrodes of the plurality of electrostatic capacitance sensors are disposed on an outer circumferential side of the side opposite to the struck surface.

5. The electronic percussion instrument according to claim 1, wherein one electrode of the electrostatic capacitance sensor is formed in a mesh shape or a perforated shape.

6. The electronic percussion instrument according to claim 5, wherein the one electrode formed in the mesh shape or the perforated shape is formed so that an electrode area is different at an inner circumferential side and an outer circumferential side of the side opposite to the struck surface.

7. The electronic percussion instrument according to claim 1, wherein the electrode of the electrostatic capacitance sensor is formed in a single line.

8. A sound production control method for detecting a strike on a struck surface of an electronic percussion instrument, which is an electronic cymbal configured to perform playing, and performing sound production control on a musical sound according to detecting result of the strike, wherein the method comprises constructing at least one electrostatic capacitance sensor by forming an electrode on a side opposite to the struck surface, and an output value of the electrostatic capacitance sensor changes in accordance with a contact state of a touch by a user when the user touches the struck surface, and performing an attenuation control to the musical sound that is being produced according to the output value of the electrostatic capacitance sensor, and the attenuation control comprises attenuating the musical sound during playing when a hand is detected approaching the struck surface according to the output value of the electrostatic capacitance sensor.

9. The method according to claim 8, the electrode is formed in a plurality of lines on the side opposite to the struck surface.

10. The method according to claim 9, wherein the electrode is formed on the side opposite to the struck surface at an inner circumferential side and an outer circumferential side of the side opposite to the struck surface, and a line of the electrode on the inner circumferential side and a line of the electrode on the outer circumferential side are formed in different areas.

11. The method according to claim 8, wherein the at least one electrostatic capacitance sensor is a plurality of electrostatic capacitance sensors, the electrode of one of the plurality of electrostatic capacitance sensors is disposed on an inner circumferential side of the side opposite to the struck surface, and other electrodes of the plurality of electrostatic capacitance sensors are disposed on an outer circumferential side of the side opposite to the struck surface.

12. The method according to claim 8, wherein the electrode of the electrostatic capacitance sensor is formed in a mesh shape or a perforated shape.

13. The method according to claim 12, wherein the electrode formed in the mesh shape or the perforated shape is formed so that an electrode area is different at an inner circumferential side and an outer circumferential side of the side opposite to the struck surface.

14. The method according to claim 8, wherein the electrode of the electrostatic capacitance sensor is formed in a single line.

* * * * *